US007545103B2

(12) United States Patent
Komatsu et al.

(10) Patent No.: US 7,545,103 B2
(45) Date of Patent: Jun. 9, 2009

(54) COLD-CATHODE TUBE LIGHTING DEVICE FOR USE IN A PLURALITY OF COLD-CATHODE TUBES LIT BY ONE LOW-IMPEDANCE POWER SOURCE

(75) Inventors: Akeyuki Komatsu, Osaka (JP); Eiji Miyake, Osaka (JP); Kenji Kawataka, Osaka (JP); Toshio Manabe, Osaka (JP)

(73) Assignee: Panasonic Corporation, Osaka (JP)

( * ) Notice: Subject to any disclaimer, the term of this patent is extended or adjusted under 35 U.S.C. 154(b) by 536 days.

(21) Appl. No.: 10/577,716

(22) PCT Filed: Apr. 21, 2005

(86) PCT No.: PCT/JP2005/007651

§ 371 (c)(1),
(2), (4) Date: Jul. 20, 2006

(87) PCT Pub. No.: WO2005/109966

PCT Pub. Date: Nov. 17, 2005

(65) Prior Publication Data

US 2007/0093165 A1 Apr. 26, 2007

(30) Foreign Application Priority Data

May 7, 2004 (JP) ..... 2004-138736

(51) Int. Cl.
*H05B 37/00* (2006.01)

(52) U.S. Cl. ..... 315/219; 315/223; 315/239; 345/102

(58) Field of Classification Search ..... 315/219, 315/224, 223, 227 R, 239; 345/102
See application file for complete search history.

(56) References Cited

U.S. PATENT DOCUMENTS

| | | | | |
|---|---|---|---|---|
| 5,959,412 | A | 9/1999 | Ushijima | |
| 6,023,131 | A * | 2/2000 | Okita | 315/291 |
| 6,661,181 | B2 * | 12/2003 | Shin | 315/169.4 |
| 6,714,111 | B2 | 3/2004 | Suzuki | |
| 2005/0023988 | A1 | 2/2005 | Komatsu et al. | |

FOREIGN PATENT DOCUMENTS

| | | |
|---|---|---|
| JP | 62-265795 | 11/1987 |
| JP | 1-166599 | 6/1989 |

(Continued)

*Primary Examiner*—David Hung Vu
(74) *Attorney, Agent, or Firm*—Wenderoth, Lind & Ponack, L.L.P.

(57) ABSTRACT

A cold-cathode tube lighting device uniformly lights multiple cold-cathode tubes using a common power source, and the cold-cathode tube lighting device is effectively downsized by using ballast capacitors. A substrate is divided into blocks as many as the cold-cathode tubes. Each of the blocks includes two conductor layers each including two foils. A first foil of a first conductor layer is connected to a common low-impedance power supply. Between the two conductor layers, first ballast capacitors are formed in areas where the first foils are overlapped, second ballast capacitors are formed in areas where the first and second foils are overlapped, and the third ballast capacitors are formed in areas where the second foils are overlapped. Second foils are connected to first electrodes of the cold-cathode tubes.

16 Claims, 20 Drawing Sheets

FOREIGN PATENT DOCUMENTS

| | | |
|---|---|---|
| JP | 6-301034 | 10/1994 |
| JP | 7-45375 | 2/1995 |
| JP | 8-122776 | 5/1996 |
| JP | 8-273862 | 10/1996 |
| JP | 8-288086 | 11/1996 |
| JP | 2002-353044 | 12/2002 |
| JP | 2004-119206 | 4/2004 |
| JP | 2005-63941 | 3/2005 |
| WO | 02/078403 | 10/2002 |

* cited by examiner

COLD-CATHODE TUBE LIGHTING DEVICE FOR USE IN A PLURALITY OF COLD-CATHODE TUBES LIT BY ONE LOW-IMPEDANCE POWER SOURCE

TECHNICAL FIELD

The present invention relates to a cold-cathode tube lighting device. In particular, the present invention relates to a device for lighting a plurality of cold-cathode tubes.

BACKGROUND ART

Fluorescent tubes are classified roughly into hot-cathode tubes and cold-cathode tubes depending on the configuration of the electrodes thereof. The electrodes of a cold-cathode tube (also referred to as a CCFL) are formed of substances that emit numerous electrons through the application of high voltage. Namely, the electrodes do not include any filaments for emitting thermal electrons, unlike the case of the hot-cathode tubes. For this reason, the cold-cathode tubes are particularly advantageous over the hot-cathode tubes in terms of very small tube diameter, long life and low power consumption. Because of the advantages, the cold-cathode tubes are mainly used frequently for products strongly requested to be made thinner (or smaller in size) and lower in power consumption, such as the backlights of liquid crystal displays, the light sources of facsimiles and scanners.

The cold-cathode tubes have electrical characteristics of higher break-down voltage, smaller discharge current (referred to as tube current hereinafter) and higher impedance than the hot-cathode tubes. In particular, the cold-cathode tubes have such negative resistance characteristics that the resistance value thereof drops abruptly as the tube current thereof increases. The configuration of a cold-cathode tube lighting device is devised so as to conform to these electrical characteristics of the cold-cathode tubes. In particular, since thinning (downsizing) and electric power saving are emphasized for devices to which the cold-cathode tubes are applied, the cold-cathode tube lighting device is also strongly requested to be made smaller in size (particularly thinner) and lower in power consumption.

For example, as a cold-cathode tube lighting device according to a prior art, the device described below has been known (for example, see Patent document 1). FIG. 20 is a circuit diagram showing a configuration of the cold-cathode tube lighting device according to the prior art. The cold-cathode tube lighting device according to the prior art includes a high-frequency oscillation circuit 100, a step-up transformer "T" and an impedance matching part 200.

The high-frequency oscillation circuit 100 converts a direct-current voltage supplied from a direct-current power source DC into an alternating-voltage having a high frequency, and applies the alternating-voltage to a primary winding L1 of the step-up transformer "T". The step-up transformer "T" generates a voltage, which is extremely higher than a primary voltage, across both ends of a secondary winding L2 thereof. The high secondary voltage "V" is applied across both ends of a cold-cathode tube FL via the impedance matching part 200. For example, the impedance matching part 200 includes a series circuit of a choke coil "L" and a capacitor "C". In this case, the capacitor "C" includes stray capacitances in the periphery of the cold-cathode tube FL. Impedance matching is performed between the step-up transformer "T" and the cold-cathode tube FL by adjusting the inductance of the choke coil "L" and the capacitance of the capacitor "C".

During the time when the cold-cathode tube FL is off, when a voltage is applied to the primary winding L1 of the transformer "T", a voltage VR across both ends of the cold-cathode tube FL is raised abruptly by a resonance of the choke coil "L" and the capacitor "C" of the impedance matching part 200, and the voltage VR exceeds a break-down voltage. As a result, the cold-cathode tube FL starts discharging, and begins to emit light. Then, a resistance value of the cold-cathode tube FL drops abruptly as the tube current IR increases (negative resistance characteristics). Along with this drop in the resistance value of the cold-cathode tube FL, the voltage VR across both ends of the cold-cathode tube FL drops. At that time, the tube current IR is maintained stably by the action of the impedance matching part 200, regardless of the change in the voltage VR across both ends of the cold-cathode tube FL. Namely, the luminance of the cold-cathode tube FL is maintained stably.

In FIG. 20, the secondary winding L2 of the step-up transformer "T" and the choke coil "L" are shown as circuit elements different from each other. However, in an actual cold-cathode tube lighting device, a secondary winding of one leakage flux transformer was used for three purposes of step-up, choking, and impedance matching. Accordingly, both the number of components and the size were reduced. Namely, in the cold-cathode tube lighting device according to the prior art, the leakage flux transformer was regarded as particularly advantageous in downsizing, and thus used frequently.

Patent document 1: Japanese patent laid-open publication No. 8-273862.

DISCLOSURE OF INVENTION

PROBLEMS TO BE SOLVED BY THE INVENTION

High luminance is particularly requested for the backlight of a liquid crystal display. Accordingly, when cold-cathode tubes are used as the backlight, it is desired that a plurality of cold-cathode tubes are installed. At that time, the luminance values of the plurality of cold-cathode tubes must be made uniform. In addition, the cold-cathode tube lighting device thereof must be small in size. For the purpose of meeting these needs, it is desired that the plurality of cold-cathode tubes are driven in parallel using a common power source.

However, the parallel driving of the plurality of cold-cathode tubes using the common power source was difficult because of the following reasons.

The cold-cathode tubes have the negative resistance characteristics as described above. Accordingly, when the plurality of cold-cathode tubes are simply connected in parallel, current concentration occurs in only one of the cold-cathode tubes, and the only one cold-cathode tube can be lit eventually. Further, when the plurality of cold-cathode tubes are connected to the common power source, wires connected among them are different from each other, more particularly, their lengths are different from each other. Accordingly, stray capacitances of the cold-cathode tubes are different from each other. Accordingly, when the plurality of cold-cathode tubes are driven in parallel, it is necessary to control the tube current for each cold-cathode tube so as to suppress the variation in the tube current.

It was difficult to perform the following of (a) using one leakage flux transformer as a common choke coil for the plurality of cold-cathode tubes, (b) attaining highly accurate impedance matching between the leakage flux transformer and each of the cold-cathode tubes, and (c) highly accurately controlling the tube currents of the individual tubes. In this case, the difficulty remained similarly even when a piezoelectric transformer is used instead of the leakage flux transformer. Accordingly, in the cold-cathode tube lighting device according to the prior art, each of the cold-cathode tubes is provided with a power source (a leakage flux transformer, in particular), while tube current of each of the cold-cathode tubes is controlled to be uniform using the power source. Namely, in the cold-cathode tube lighting device according to the prior art, the power sources as many as the cold-cathode tubes were required. As a result, it was difficult to reduce the number of components so as to further downsize the whole device.

An object of the present invention is to provide a cold-cathode tube lighting device that can be further downsized by uniformly lighting a plurality of cold-cathode tubes using a common power source.

MEANS FOR SOLVING THE PROBLEMS

A cold-cathode tube lighting device according to the present invention includes a circuit board on which one end of each of a plurality of cold-cathode tubes is mounted, where the circuit board includes at least two conductor layers. In addition, the cold-cathode tube lighting device includes a plurality of ballast capacitors each having a capacitance between the two conductor layers, where at least one of the ballast capacitors are connected to an electrode at the one end of each of the cold-cathode tubes, and a low-impedance power source having an output impedance lower than a combined impedance of the plurality of cold-cathode tubes, where the low-impedance power source supplies electric power to the cold-cathode tubes via the ballast capacitors.

The cold-cathode tube lighting device is preferably installed into a liquid crystal display as described below. The liquid crystal display includes the plurality of cold-cathode tubes and a liquid crystal panel installed on the front side of the cold-cathode tubes, for shielding light emitted from the cold-cathode tubes using a predetermined pattern. The cold-cathode tube lighting device according to the present invention drives the above-mentioned plurality of cold-cathode tubes serving as the backlight of the liquid crystal display.

Generally speaking, among the plurality of cold-cathode tubes, stray capacitances in the periphery thereof vary owing to the differences in the installation conditions (for example, wire length or pattern, the distance between the tube wall and the outside (for example, the case containing the liquid crystal display), and the like), and the leakage current flowing between the tube wall and the outside varies in particular.

In the above-mentioned cold-cathode tube lighting device according to the present invention, the output impedance of the power source is suppressed, contrary to the presumption in the device according to the prior art. Instead, one ballast capacitor is connected to each of the cold-cathode tubes.

The capacitance of the ballast capacitor is preferably adjusted for each cold-cathode tube. Accordingly, the variation in capacitance among the ballast capacitors accurately coincides with the variation in stray capacitances among the plurality of cold-cathode tubes. Namely, the impedance of each ballast capacitor is matched with the combined impedance of the stray capacitances in the periphery of each cold-cathode tube. As a result, among the plurality of cold-cathode tubes, the tube currents are maintained uniformly, regardless of the variation in leakage current owing to the differences in installation conditions, in particular. Namely, even if the wires between the low-impedance power source and the respective ballast capacitors are long, and even if they are significantly different for the respective ballast capacitors, no variation occurs in tube current among the plurality of cold-cathode tubes. Accordingly, luminance is maintained uniformly among the plurality of cold-cathode tubes, regardless of the differences in the installation conditions.

Thus, the above-mentioned cold-cathode tube lighting device according to the present invention uniformly lights the plurality of cold-cathode tubes using the common low-impedance power source.

In the above-mentioned cold-cathode tube lighting device according to the present invention, the layout of the wiring is high in flexibility, and long wires may be used in particular. At that time, the low-impedance power source is preferably installed on a circuit board different from the above-mentioned circuit board. Such circuit board separation is easily realized without impairing the uniformity in luminance among the plurality of cold-cathode tubes.

Generally speaking, other circuit elements, such as the ballast capacitors, are smaller in size than the low-impedance power source. In addition, the heat generation in the ballast capacitors owing to power consumption is low. Accordingly, when the circuit board on which the ballast capacitors are mounted is separated from the circuit board on which the low-impedance power source is mounted, and the circuit board is installed in the close vicinity of the cold-cathode tubes, the part comprising the circuit board on which the ballast capacitors are mounted and the cold-cathode tubes can be made thinner easily.

For example, when the cold-cathode tubes are used as the backlight of a liquid crystal display, the thinning of the display is realized easily. Namely, the above-mentioned cold-cathode tube lighting device according to the present invention is particularly advantageous in the use as the backlight driving device of the liquid crystal display.

In the above-mentioned cold-cathode tube lighting device according to the present invention, the low-impedance power source is adopted, and the impedance of the ballast capacitor is set as high as the impedance of the cold-cathode tube as described above. Accordingly, the capacitance of the ballast capacitor is small. Accordingly, the ballast capacitor can be realized as the capacitance among the conductor layers of the circuit board. At that time, since the ballast capacitor is wholly embedded inside the circuit board, its size, particularly its thickness, is significantly smaller than that of the conventional one. As a result, even in the case that the plurality of cold-cathode tubes are driven in parallel, the connection parts between the cold-cathode tube lighting device and the cold-cathode tubes are small and particularly thin. The improvement in the thinning at the connection parts is particularly advantageous in the use as the backlight driving device of the liquid crystal display.

In this way, in the above-mentioned cold-cathode tube lighting device according to the present invention, the use of the ballast capacitors is extremely effective in downsizing the whole device.

The circuit board on which the above-mentioned ballast capacitors are mounted is preferably a multi-layer circuit board or a flexible printed circuit board. In this case, the conductor layers thereof are preferably copper foils.

Since the above-mentioned ballast capacitors are formed of the circuit board materials themselves, they are high in all of heat resistance, withstand voltage and flame retardancy.

Since the thicknesses of all the layers are accurately uniform inside the circuit board, variation in the capacitances of the above-mentioned ballast capacitors is small.

In addition, the shapes of the conductor layers can be formed easily even if they are relatively complicated, and the number of the layers in the circuit board can be adjusted relatively easily. Accordingly, a plurality of ballast capacitors can be connected easily in series or in parallel. Accordingly, the above-mentioned ballast capacitors have a high degree of freedom for the setting of withstand voltage and capacitance.

In the above-mentioned circuit board, the conductor layers are preferably conductor films evaporated. Such conductor layers have the so-called self-healing property, that is, the conductor layers are fused at the occurrence time of overcurrent so as to suppress overcurrent. Accordingly, the cold-cathode tubes and the cold-cathode tube lighting device can avoid breakdown owing to overcurrent.

In the above-mentioned cold-cathode tube lighting device according to the present invention, an impedance of each of the ballast capacitors, a combined impedance of a stray capacitance in the periphery of each of the cold-cathode tubes, and an impedance of each of the cold-cathode tubes during lighting are preferably matched with each other. Since the ballast capacitors are formed of the capacitances among the conductor layers of the circuit board in particular, the setting of the capacitances is easy, and the variation in the capacitances is small. Accordingly, the above-mentioned impedance matching is accurately realized for each combination of the ballast capacitors and the cold-cathode tube. Accordingly, since the tube currents are maintained uniformly among the plurality of cold-cathode tubes, regardless of the variation in the stray capacitances in the periphery thereof, the luminance is maintained uniformly.

In the above-mentioned cold-cathode tube lighting device according to the present invention, a series connection circuit of at least two of the ballast capacitors is preferably connected to the electrode at one end of each of the cold-cathode tubes. Since the above-mentioned ballast capacitors are formed as capacitances among the conductor layers of the circuit board, the withstand voltage of each one is relatively low. Accordingly, the whole withstand voltage thereof is raised sufficiently by connecting a plurality of ballast capacitors in series to each other.

In the above-mentioned cold-cathode tube lighting device according to the present invention, a surface of the circuit board and a surface of each of the cold-cathode tubes are preferably disposed so as to be separated from each other by a predetermined distance determined by a temperature difference and an electric potential difference between the surface of the circuit board and the surface of each of the cold-cathode tubes.

During the lighting of the cold-cathode tube, its surface temperature is high. In addition, the amplitude of the electric potential at the electrode of the cold-cathode tube is large. Accordingly, in the cold-cathode tube lighting device, the connection part to the cold-cathode tube must be configured to avoid malfunction due to high temperature and failure due to dielectric breakdown.

Since the ballast capacitors are wholly embedded inside the circuit board in the above-mentioned cold-cathode tube lighting device according to the present invention, malfunction due to high temperature and failure due to dielectric breakdown can be avoided by the adjustment of the clearance between the surface of the circuit board itself and the surface of the cold-cathode tube, unlike the case of the device according to the prior art. At that time, since the circuit board is high in both heat resistance and withstand voltage, the clearance between the surface of the circuit board and the surface of the cold-cathode tube may be made small. Accordingly, in the above-mentioned cold-cathode tube lighting device according to the present invention, the connection part to the cold-cathode tube can be thinned easily. The improvement in thinning at the connection part is particularly advantageous in the use as the backlight driving device of a liquid crystal display.

In the above-mentioned cold-cathode tube lighting device according to the present invention, a surface of the circuit board is preferably disposed so as to be perpendicular to a longitudinal direction of the cold-cathode tubes. Accordingly, the connection part to the cold-cathode tube can be downsized while the distance between the surface of the circuit board and the surface of the cold-cathode tube is maintained within a safe range. Further, the end part of the cold-cathode tube is easily installed on the above-mentioned circuit board and held stably.

When the surface of the circuit board is disposed so as to be perpendicular to a longitudinal direction of the cold-cathode tubes, it is further preferable that, a conductor layer closest to the cold-cathode tubes among the conductor layers is connected to electrodes of the cold-cathode tubes, and a conductor layer farthest from the plurality of cold-cathode tubes among the conductor layers is connected to the low-impedance power source. In addition, when the circuit board includes at least three the conductor layers, a conductor layer closest to the cold-cathode tubes among the conductor layers and a conductor layer farthest from the plurality of cold-cathode tubes among the conductor layers may be each connected to the low-impedance power source. In this case, the conductor layer away from the circuit board is connected to the electrode of each of the cold-cathode tubes.

For example, as a conductor layer is farther from the outside of the circuit board (for example, the case of a liquid crystal display), the stray capacitance between the layer and the outside is smaller. Accordingly, in the above-mentioned connection between the conductor layer of the circuit board and the electrode of the cold-cathode tube, the electric potential at the electrode of the cold-cathode tube is hardly affected by the stray capacitance between the conductor layer and the outside. On the other hand, the output of the low-impedance power source is stable regardless of load, more particularly, the magnitude of the stray capacitance between the conductor layer and the outside.

Accordingly, since the variation in the electric potential at the electrode is further suppressed among the plurality of cold-cathode tubes, the uniformity of the tube current, that is, the uniformity of luminance, is improved further.

In the above-mentioned cold-cathode tube lighting device according to the present invention, the low-impedance power source preferably includes a transformer connected to the ballast capacitors, and the transformer has an output impedance lower than the combined impedance of the plurality of cold-cathode tubes. Accordingly, since the output impedance of the transformer is suppressed, contrary to the presumption in the device according to the prior art, a power source having a low output impedance is realized.

As a means being effective in reducing the output impedance of the transformer, for example, the transformer may include a core, a primary winding being wound around the core, and a secondary winding being wound around at least one of the inside and outside of the primary winding. Accordingly, the leakage flux is reduced, and the output impedance is suppressed. Further, adverse effects (for example, noise generation) to peripheral apparatuses due to leakage flux are suppressed.

In this case, the secondary winding of the transformer may have one configuration of a sectional winding and a honeycomb winding. With this configuration, since the capacitance between the wires is reduced, the self-resonant frequency of the secondary winding can be set to be sufficiently high. For this reason, in the above-mentioned cold-cathode tube lighting device according to the present invention, the operation frequency can be set to be sufficiently high while the light emission of the plurality of cold-cathode tubes is maintained stably. Accordingly, the downsizing of the transformer and the resultant downsizing of the whole device are realized easily.

In the above-mentioned cold-cathode tube lighting device according to the present invention, the low-impedance power source may have power transistors connected to the ballast capacitors, instead of the above-mentioned transformer. The use of the power transistors can reduce the output impedance easily and effectively. Accordingly, the above-mentioned cold-cathode tube lighting device according to the present invention can uniformly light a larger number of cold-cathode tubes.

EFFECTS OF THE INVENTION

Unlike the device according to the prior art, the above-mentioned cold-cathode tube lighting device according to the present invention includes a plurality of ballast capacitors, at least one of which is connected to each of a plurality of cold-cathode tubes, and a common low-impedance power source so as to uniformly lighten the plurality of cold-cathode tubes using the common power source. Further, the wires between the power source and the ballast capacitors may be long and may be significantly different for each ballast capacitor, and therefore the layout of the wiring is high in flexibility. Accordingly, the downsizing of the whole device is realized more easily than that of the device according to the prior art.

In addition, in the above-mentioned cold-cathode tube lighting device according to the present invention, the ballast capacitors are formed as the capacitances among the conductor layers of the circuit board. Accordingly, since the ballast capacitors are wholly embedded inside the circuit board, the connection parts to the cold-cathode tubes are significantly thin. In particular, when the above-mentioned cold-cathode tube lighting device according to the present invention is used as the backlight driving device of a liquid crystal display, the use of the above-mentioned ballast capacitors is extremely effective in thinning the liquid crystal display.

DESCRIPTION OF NUMERICAL REFERENCES

Figure 1:
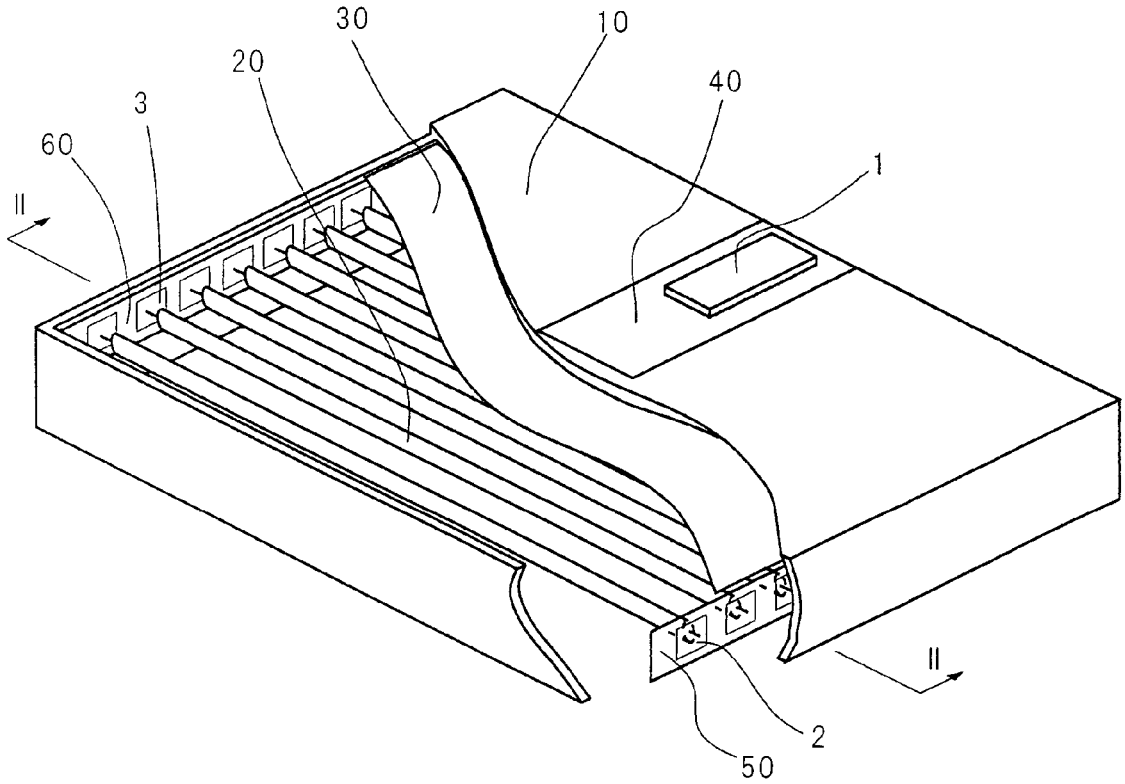
FIG. 1 is a perspective view showing a configuration of a backlight of a liquid crystal display in which a cold-cathode tube lighting device according to a first preferred embodiment of the present invention is installed.

20 cold-cathode tube
20A first electrode of the cold-cathode tube 20
50 second circuit board
2 second block
2U1 first upper-side foil
2U2 second upper-side foil
2D1 first lower-side foil
2D2 second lower-side foil
E1 first through hole
E2 second through hole
W1 first lead wire
W2 second lead wire

BEST MODE FOR CARRYING OUT THE INVENTION

Best preferred embodiments of the present invention will be described below referring to the drawings.

First Preferred Embodiment

Figure 2:
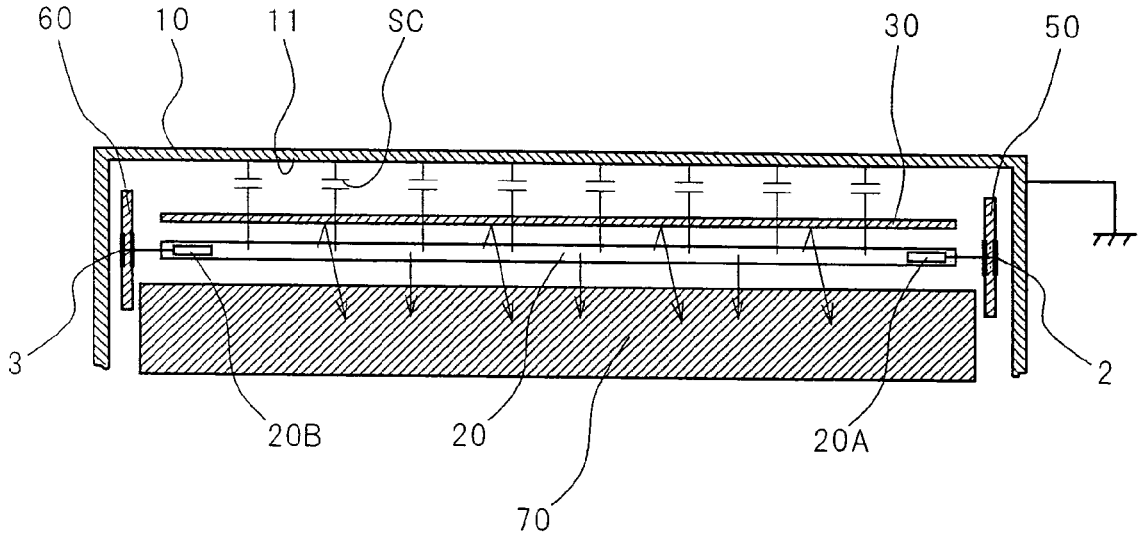
FIG. 2 is a sectional view of the liquid crystal display, taken along line II-II shown in FIG. 1.

FIG. 1 is a perspective view showing a configuration of a backlight of a liquid crystal display in which a cold-cathode tube lighting device according to a first preferred embodiment of the present invention is installed. In FIG. 1, a case 10 is shown with its back plate facing upward. In addition, the back plate and side plates of the case 10 are partly removed to show the inside of the case 10. FIG. 2 is a sectional view taken along line II-II shown in FIG. 1 (the arrows shown in FIG. 1 show a visual line direction).

The liquid crystal display shown in FIGS. 1 and 2 includes the case 10, a plurality of cold-cathode tubes 20, a reflecting plate 30, a first circuit board 40, a second circuit board 50, a third circuit board 60, and a liquid crystal panel 70. The cold-cathode tube lighting device according to the first preferred embodiment of the present invention is mainly divided into three blocks 1, 2 and 3 that are mounted on the first circuit board 40, the second circuit board 50 and the third circuit board 60, respectively.

The case 10 is a box made of metal, for example, and the box 10 is grounded so that both the electromagnetic noise emanated from the cold-cathode tubes 20 and the electromagnetic noise coming from the outside of the case 10 are shielded.

The front side (the lower side in FIGS. 1 and 2) of the case 10 is open, and the reflecting plate 30, the cold-cathode tubes 20 and the liquid crystal panel 70 (not shown in FIG. 1) are accommodated inside in this order from the rear.

The cold-cathode tubes 20 includes a plurality of (for example 16) cold-cathodes tubes. Both ends of each of the cold-cathode tubes 20 are covered with rubber tubes (not shown), respectively, for example. The tubes are supported on brackets (not shown). Accordingly, the cold-cathode tubes 20 are held horizontally and arranged at equal intervals in the vertical direction of the liquid crystal display.

On both sides of the cold-cathode tubes 20, the second circuit board 50 and the third circuit board 60 are installed so as to be perpendicular to the longitudinal direction of the cold-cathode tubes 20, for example. Accordingly, connection parts to respective cold-cathode tubes 20 are downsized while the distance between the surface of the second circuit board 50 and the surface of each of the cold-cathode tubes 20, and the distance between the surface of the third circuit board 60 and the surface of each of the cold-cathode tubes 20 are maintained in a safe range. In addition, the end parts of the cold-cathode tubes 20 are easily installed on the second circuit board 50 and the third circuit board 60, and the cold-cathode tubes 20 are held stably.

Each of the second circuit board 50 and the third circuit board 60 is preferably a multi-layer circuit board. In addition, each of the second circuit board 50 and the third circuit board 60 may be a flexible printed circuit board. Accordingly, the second circuit board 50 and the third circuit board 60 are high in heat resistance, withstand voltage and flame retardancy.

Each of the second circuit board 50 and the third circuit board 60 includes conductor layers, preferably copper foils, therein. Each of the cold-cathode tubes 20 is provided with the second block 2 and the third block 3 of the cold-cathode tube lighting device, and the second block 2 and the third block 3 are circuits mainly formed of patterns of the respective conductor layers of the second circuit board 50 and the third circuit board 60, respectively. Each of the cold-cathode tubes 20 is provided with electrodes 20A and 20B (referred to as a first electrode and a second electrode hereinafter) at both ends thereof, and the electrodes 20A and 20B are connected to the second block 2 and the third block 3, respectively.

The second block 2 and the third block 3 are wholly embedded inside the circuit boards (See FIG. 2, further details will be described later). Accordingly, the second block 2 and the third block 3 can avoid malfunction due to high temperature and failure due to dielectric breakdown, by adjusting the clearance between the surface of the second circuit board 50 and the surface of each of the cold-cathode tubes 20, and the clearance between the surface of the third circuit board 60 and the surface of each of the cold-cathode tubes 20. In this case, since the circuit boards are high in heat resistance and withstand voltage, the clearances described above may be made small. It is particularly preferable that the second circuit board 50 and the third circuit board 60 are installed inside the case 10 and in the vicinity of the cold-cathode tubes 20. In this case, the clearance between the surface of the circuit board and the surface of the cold-cathode tubes 20 is determined by the temperature difference and the electric potential difference between the circuit board and the cold-cathode tubes 20, and the clearance is 0.1 to 10 [mm], for example. As described above, the connection parts to the cold-cathode tubes 20 are small and particularly thin in the cold-cathode tube lighting device according to the first preferred embodiment of the present invention.

The second block 2 and the third block 3 are connected to the first block 1 provided on the first circuit board 40 (the wirings therefor are not shown). The first circuit board 40 is disposed on the outside of the case 10, for example, on the back plate of the case 10. The first block 1 is connected to a direct-current power source (not shown).

The cold-cathode tube lighting device distributes the electric power supplied from the direct-current power source to each of the cold-cathode tubes 20 via the three blocks 1, 2 and 3 so that each of the cold-cathode tubes 20 emits light. The light emitted from the cold-cathode tubes 20 enters the liquid crystal panel 70 directly or after being reflected by the reflector 30 (See arrows shown in FIG. 2). The liquid crystal panel 70 shields incident light emitted from the cold-cathode tubes 20 using a predetermined pattern so as to display the pattern on the front face of the liquid crystal panel 70.

Figure 3:
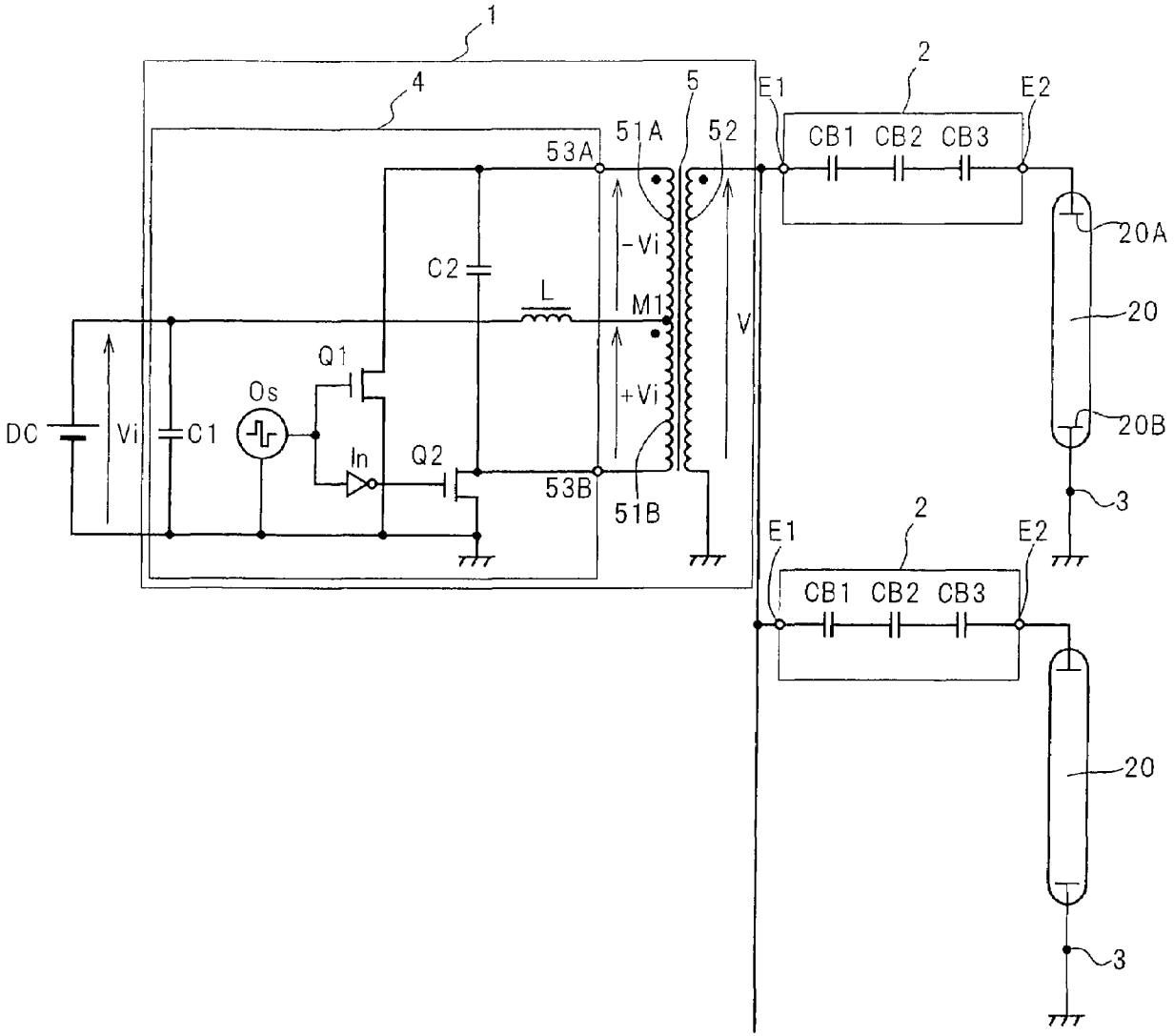
FIG. 3 is a circuit diagram showing a configuration of the cold-cathode tube lighting device according to the first preferred embodiment of the present invention.

FIG. 3 is a circuit diagram showing a configuration of the cold-cathode tube lighting device according to the first preferred embodiment of the present invention. The cold-cathode tube lighting device mainly includes the three blocks 1, 2 and 3 described above.

The first block 1 includes a high-frequency oscillation circuit 4 and a step-up transformer 5, and the first block 1 is configured as a parallel resonance type push-pull inverter. The high-frequency oscillation circuit 4 includes an oscillator Os, a first capacitor C1, a second capacitor C2, an inductor "L", a first transistor Q1, a second transistor Q2, and an inverter In. The step-up transformer 5 includes a primary winding that is divided into two primary windings 51A and 51B at the neutral point M1 thereof, and a secondary winding 52.

A positive electrode of a direct-current power source DC is connected to one terminal of the inductor "L", and a negative electrode thereof is grounded. The first capacitor C1 is connected across both electrodes of the direct-current power source DC. The other terminal of the inductor "L" is connected to the neutral point M1 between the primary windings 51A and 51B of the step-up transformer 5. The second capacitor C2 is connected across the other terminal 53A of the first primary winding 51A and the other terminal 53B of the second primary winding 51B. The terminal 53A of the first primary winding 51A is further connected to one terminal of the first transistor Q1. The terminal 53B of the second primary winding 51B is further connected to one terminal of the second transistor Q2. The other terminals of the first transistor Q1 and the second transistor Q2 are both grounded. In this case, the two transistors Q1 and Q2 are preferably MOS FETs. In addition, they may also be IGBTs or bipolar transistors. The oscillator Os is directly connected to a control terminal of the first transistor Q1, and the oscillator Os is connected to a control terminal of the second transistor Q2 via the inverter In.

The direct-current power source DC maintains its output voltage Vi at a constant value (for example, 16 [V]). The first capacitor C1 stably maintains the input voltage Vi supplied from the direct-current power source DC. The oscillator Os outputs a pulse wave having a constant frequency (for example, 45 [kHz]) to the control terminals of the two transistors Q1 and Q2. The polarity of the pulse wave inputted to the control terminal of the second transistor Q2 is made opposite with respect to the polarity of the pulse wave inputted to the control terminal of the first transistor Q1. Accordingly, the two transistors Q1 and Q2 are turned on and off alternately at the same frequency as the frequency of the oscillator Os. As a result, the input voltage Vi is alternately applied to the primary windings 51A and 51B of the step-up transformer 5. The inductor "L" and the second capacitor C2 cause resonance at each application of the voltage, and a polarity of a secondary voltage "V" of the step-up transformer 5 is inverted at the same frequency as the frequency of the oscillator Os. In this case, an effective value of the secondary voltage "V" is substantially the same as a product of the voltage Vi applied to the primary winding 51A and 51B and a step-up ratio (a winding ratio of the primary winding 51A to the secondary winding 52) of the step-up transformer 5. The effective value of the secondary voltage "V" is preferably set at approximately 1.5 times a lamp voltage of each of the cold-cathode tubes 20 (for example, 1800 [V]).

Thus, the first block 1 converts the output voltage Vi of the direct-current power source DC into an alternating-current voltage "V" having a high frequency (for example, 45 [kHz]). In this case, the first block 1 is not limited to the parallel resonance type push-pull inverter described above, but may be an inverter of another type (including a transformer).

In the cold-cathode tube lighting device according to the first preferred embodiment of the present invention, the leakage flux of the step-up transformer 5 described above is suppressed to be small as described below, contrary to the presumption in the device according to the prior art. Accordingly, the first block 1 functions as a power source having a low output impedance, that is, a low-impedance power source.

Figure 4:
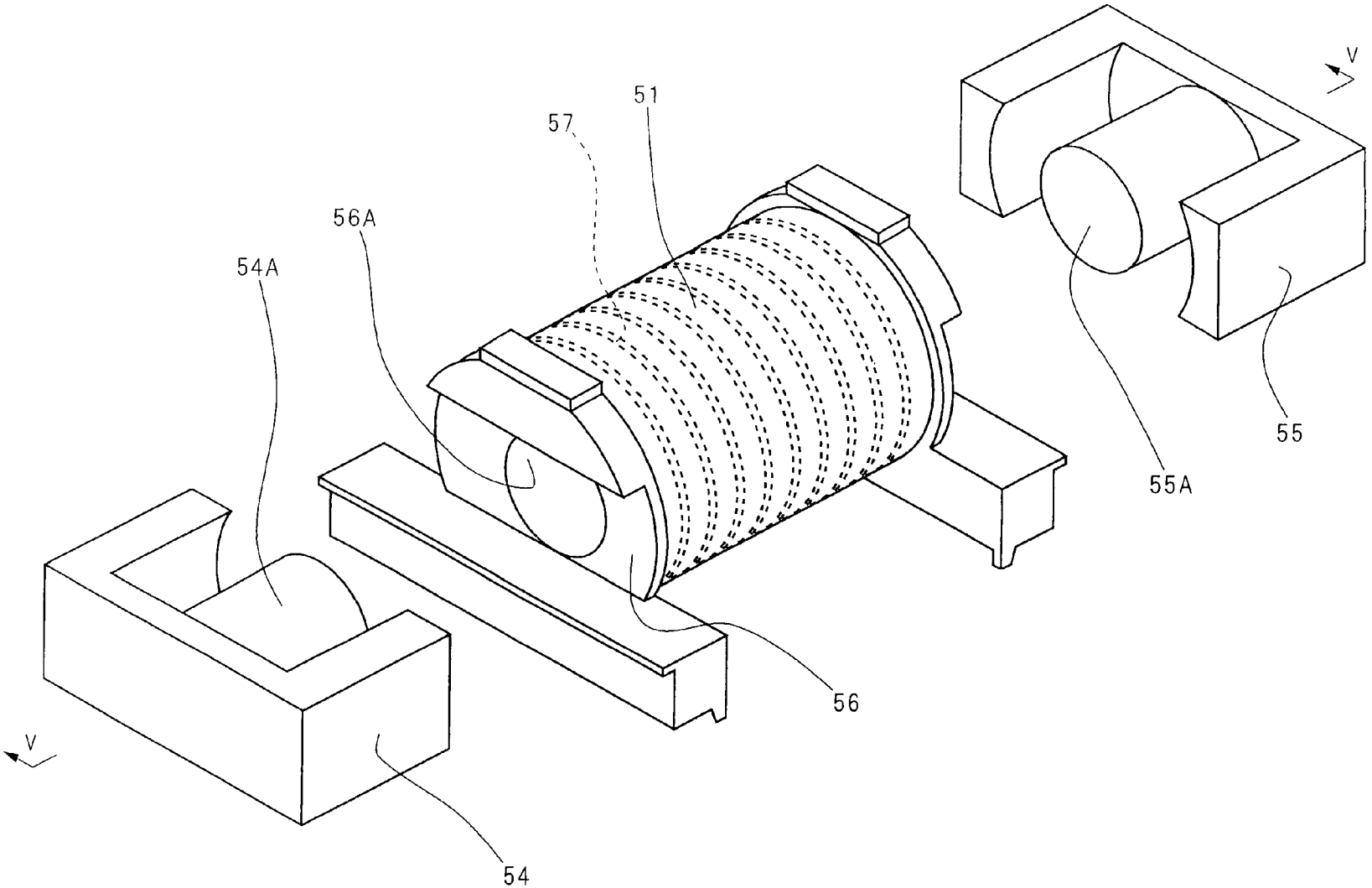
FIG. 4 is an exploded view schematically showing a configuration of a step-up transformer 5 included in the cold-cathode tube lighting device according to the first preferred embodiment of the present invention.
Figure 5:
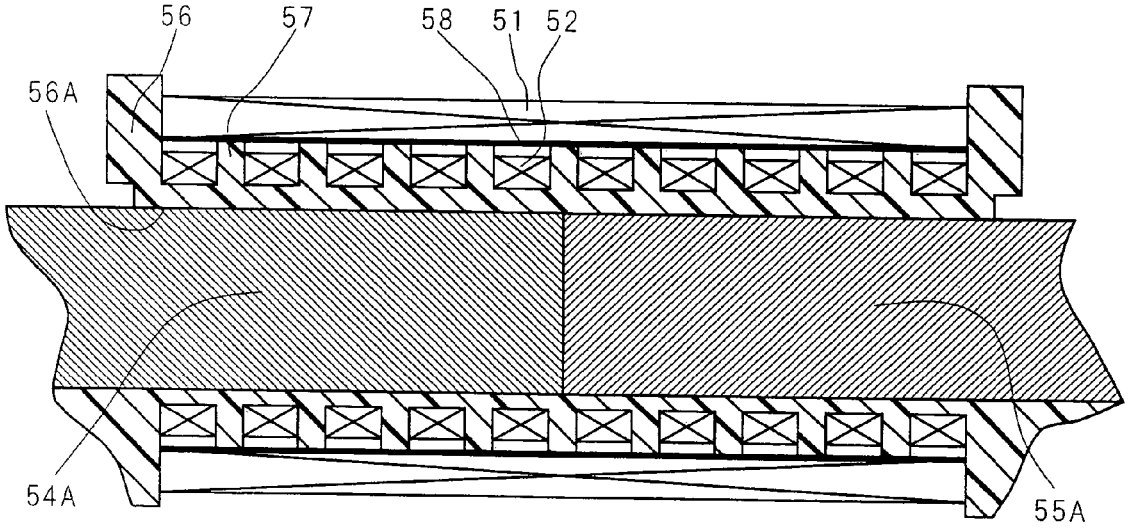
FIG. 5 is a sectional view of the step-up transformer 5, taken along line V-V shown in FIG. 4.

FIG. 4 is an exploded view schematically showing a configuration of the step-up transformer 5. FIG. 5 is a sectional view of the step-up transformer 5, taken along line V-V shown in FIG. 4 (the arrows shown in FIG. 4 show a visual line direction).

The step-up transformer 5 includes a primary winding 51 (a combination of the two primary windings 51A and 51B described above), the secondary winding 52, two E-shaped cores 54 and 55, a bobbin 56, and an insulating tape 58. The bobbin 56 is made of a synthetic resin, for example, and has the shape of a hollow cylinder. The respective central protrusions 54A and 55A of the E-shaped cores 54 and 55 are inserted into a hollow part 56A of the bobbin 56, through openings on both sides of the bobbin 56. On the outer circumferential face of the bobbin 56, a plurality of partitions 57 are provided at equal intervals in the axial direction. First, the secondary winding 52 is wound between the partitions 57. Next, the insulating tape 58 is wound around the outside of the secondary winding 52. Finally, the primary winding 51 is wound around the outside of the insulating tape 58. In this case, the secondary winding 52 may also be wound around the outside of the primary winding 51 or around both the inside and outside of the primary winding 51. Leakage flux is reduced significantly by winding the primary winding 51 and the secondary winding 52 so as to be overlaid as described above. Accordingly, an output impedance of the step-up transformer 5 is low. In particular, the output impedance is set so as to be lower than a combined impedance of all the plurality of cold-cathode tubes 20 connected in parallel to each other (See FIG. 3).

In the step-up transformer 5 described above, the secondary winding 52 is wound by a sectional winding as described above. In addition, the secondary winding 52 may also be wound by a honeycomb winding so as to prevent the discharge between the windings, and to suppress small the capacitance between the wires. Accordingly, a self-resonant frequency of the secondary winding 52 can be set to be sufficiently high.

Each second block 2 includes a series connection of three ballast capacitors CB1, CB2 and CB3, for example (See FIG. 3). Each of the ballast capacitors CB1, CB2 and CB3 is composed of capacitances among the conductor layers inside the second circuit board 50 (the details will be described later). In this case, since the number of capacitors to be connected in series to each other is determined by a relationship between a withstand voltage among the conductor layers and a withstand voltage required for the whole of the capacitors, the number may be other than three in general. Changing the number is done easily as described later.

Figure 6:
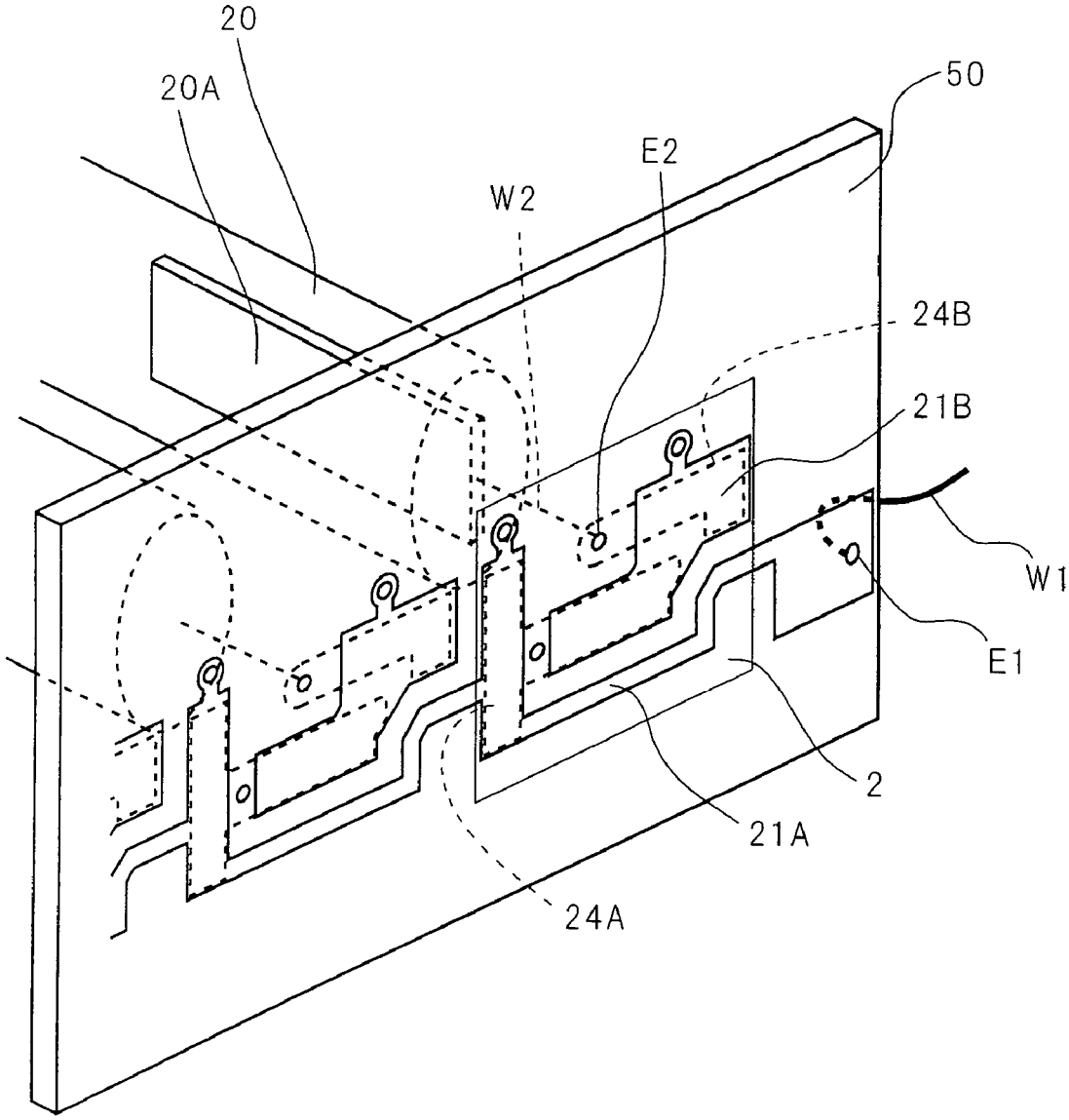
FIG. 6 is a magnified view showing the vicinity of a connection part between a second circuit board 50 and cold-cathode tubes 20 in the cold-cathode tube lighting device according to the first preferred embodiment of the present invention.

FIG. 6 is a magnified view showing the vicinity of a connection part between the second circuit board 50 and the cold-cathode tubes 20. The second circuit board 50 is divided into small areas as many as the cold-cathode tubes 20 in a longitudinal direction thereof, and each of the small areas constitutes the second block 2. Each second block 2 includes at least two conductor layers. In the first preferred embodiment of the present invention, each second block 2 includes four conductor layers, that is, the second circuit board 50 is a four-layer circuit board (the details will be described later). The respective patterns of the conductor layers are common among the second blocks 2. Further, in the first preferred embodiment of the present invention, a first conductor layer and a third conductor layer have similar patterns, and a second conductor layer and a fourth conductor layer have the same pattern (the details will be described later). In FIG. 6, the first and fourth conductor layers close to the surfaces of the second circuit board 50 are shown.

The first conductor layer includes two foils 21A and 21B, for example. The second blocks 2 are connected to each other using the first foil 21A, for example, and the second blocks 2 are further connected to a first through hole E1 provided at an end part of the second circuit board 50. The first through hole E1 is an input terminal common to all of the second blocks 2. The first through hole E1 is connected to the first block 1 (See FIG. 1) using a first lead wire W1, for example. In this case, the first lead wire W1 is soldered to the first through hole E1.

The fourth conductor layer includes two foils 24A and 24B, for example. The first electrode 20A of each of the cold-cathode tubes 20 is connected to the second foil 24B of the second block 2 using a second lead wire W2, for example. A second through hole E2 is provided in each second foil 24B. The second lead wire W2 is soldered to the second through hole E2. Thus, each second through hole E2 is used as an output terminal of each second block 2.

Figure 7:
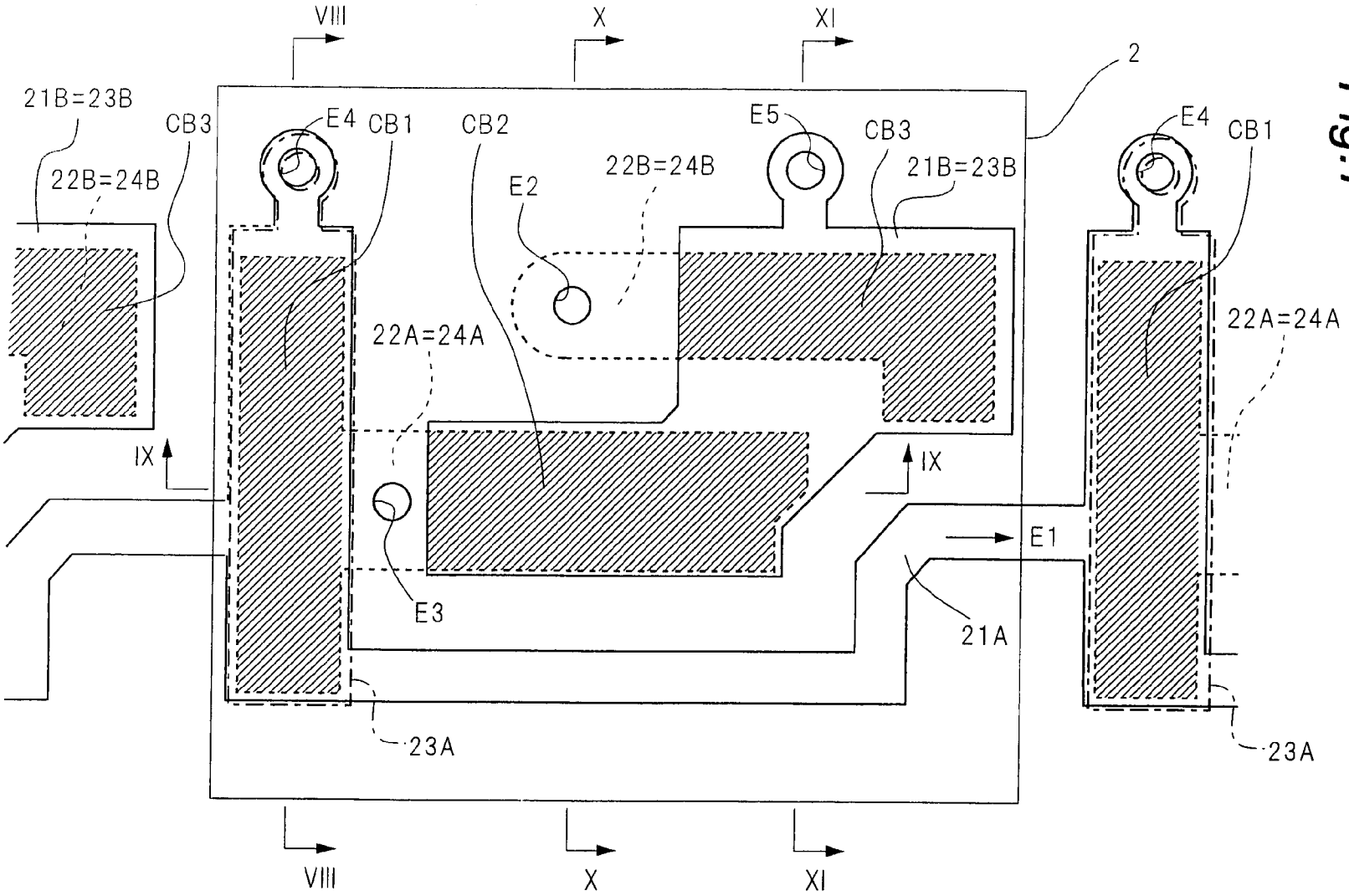
FIG. 7 is a plan view showing a pattern for conductor layers inside the second circuit board 50 constituting a second block 2 in the cold-cathode tube lighting device according to the first preferred embodiment of the present invention.

FIG. 7 is a plan view showing a preferable pattern for the conductor layers included inside the second circuit board 50 constituting the second block 2. In FIG. 7, the two foils 21A and 21B of the first conductor layer are indicated by solid lines, and the respective two foils, 22A and 24A and 22B and 24B, of the second and fourth conductor layers are indicated by broken lines, respectively. In addition, the first foil 23A of the third conductor layer is indicated by a long and short dash line. Further, the second foil 23B of the third conductor layer is indicated by the same solid line as that for the second foil 21B of the first conductor layer.

FIGS. 8 to 11 are sectional views showing the second circuit board 50, taken along line VIII-VIII, line IX-IX, line X-X and line XI-XI shown in FIG. 7, respectively (the arrows shown in FIG. 7 show visual line directions). In FIGS. 8 to 11, the dimensions in the vertical direction (the direction in the thickness of the circuit board) are made larger than those in the horizontal direction.

The second circuit board 50 includes foils 21A and 21B of the first conductor layer, foils 22A and 22B of the second conductor layer, the foils 23A and 23B of the third conductor layer, and foils 24A and 24B of the fourth conductor layer (See FIGS. 8 to 11) in this order from the surface of the case 10 (See FIGS. 1 and 2). In FIGS. 8 to 11, the cross section of the second circuit board 50 is shown with the surface of the case 10 facing upward.

The first and third conductor layers have similar patterns. In addition, the first and third conductor layers include the first foils 21A and 23A having similar shapes, respectively, at the same positions as viewed in the direction normal to the surface of the foils. Further, the first and third conductor layers include the second foils 21B and 23B having the same shape, respectively, at the same positions as viewed in the direction normal to the surfaces of the foils (See FIG. 7). Unlike the first foil 21A of the first conductor layer, as for the first foil 23A of the third conductor layer, the first foils 23A of adjoining second blocks 2 are separated from each other. The first foils 21A and 23A are connected to each other via a fourth through hole E4 (See FIGS. 7 and 8), and the second foils 21B and 23B are connected to each other via a fifth through hole E5 (See FIGS. 7 and 11).

The second and fourth conductor layers have the same pattern. In addition, the second and fourth conductor layers include the first foils 22A and 24A having the same shape, respectively, at the same positions as viewed in the direction normal to the surfaces of the foils. Further, the second and fourth conductor layers include the second foils 22B and 24B having the same shape at the same positions as viewed in the direction normal to the surfaces of the foils (See FIG. 7). The first foils 22A and 24A are connected via a third through hole E3 (See FIGS. 7 and 9), and the second foils 22B and 24B are connected via the second through hole E2 (See FIGS. 7 and 10).

The second circuit board 50 is formed by overlaying three core members B1 to B3 as described below, for example. In this case, each of the three core members B1 to B3 is a plate made of an epoxy resin containing glass fiber as a reinforcing material, for example, and having a thickness of 0.1 to 1.2 [mm].

The first conductor layer is formed on the upper face of the first core member B1, and the second conductor layer is formed on the second core member B2. The third and fourth conductor layers are formed on the upper face and the lower face of the third core member B3, respectively. Each conductor layer is a copper foil having a thickness of 12 to 70 [μm], preferably 35 [μm], for example, and is formed by evaporation. Further, the respective patterns of the conductor layers are preferably formed by etching.

Prepregs (molding intermediate materials made of a reinforcing material, such as carbon fibers, impregnated with a synthetic resin, such as an epoxy resin) P1 and P2 are used to perform bonding among the core members B1 to B3. The thickness of each of the prepregs P1 and P2 is 20 to 200 [μm], for example.

Figure 8:
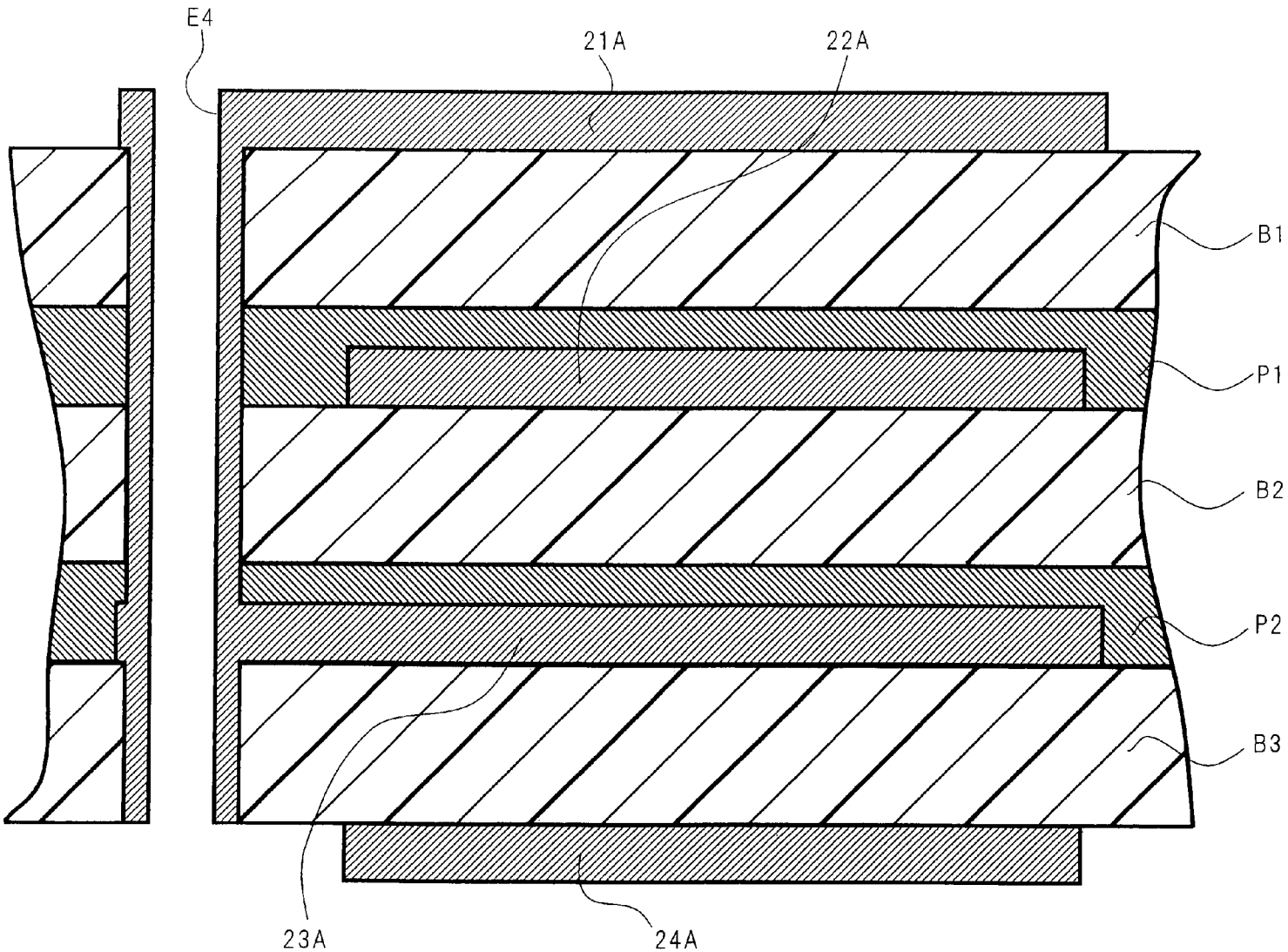
FIG. 8 is a sectional view of the second circuit board 50, taken along line VIII-VIII shown in FIG. 7.
Figure 9:
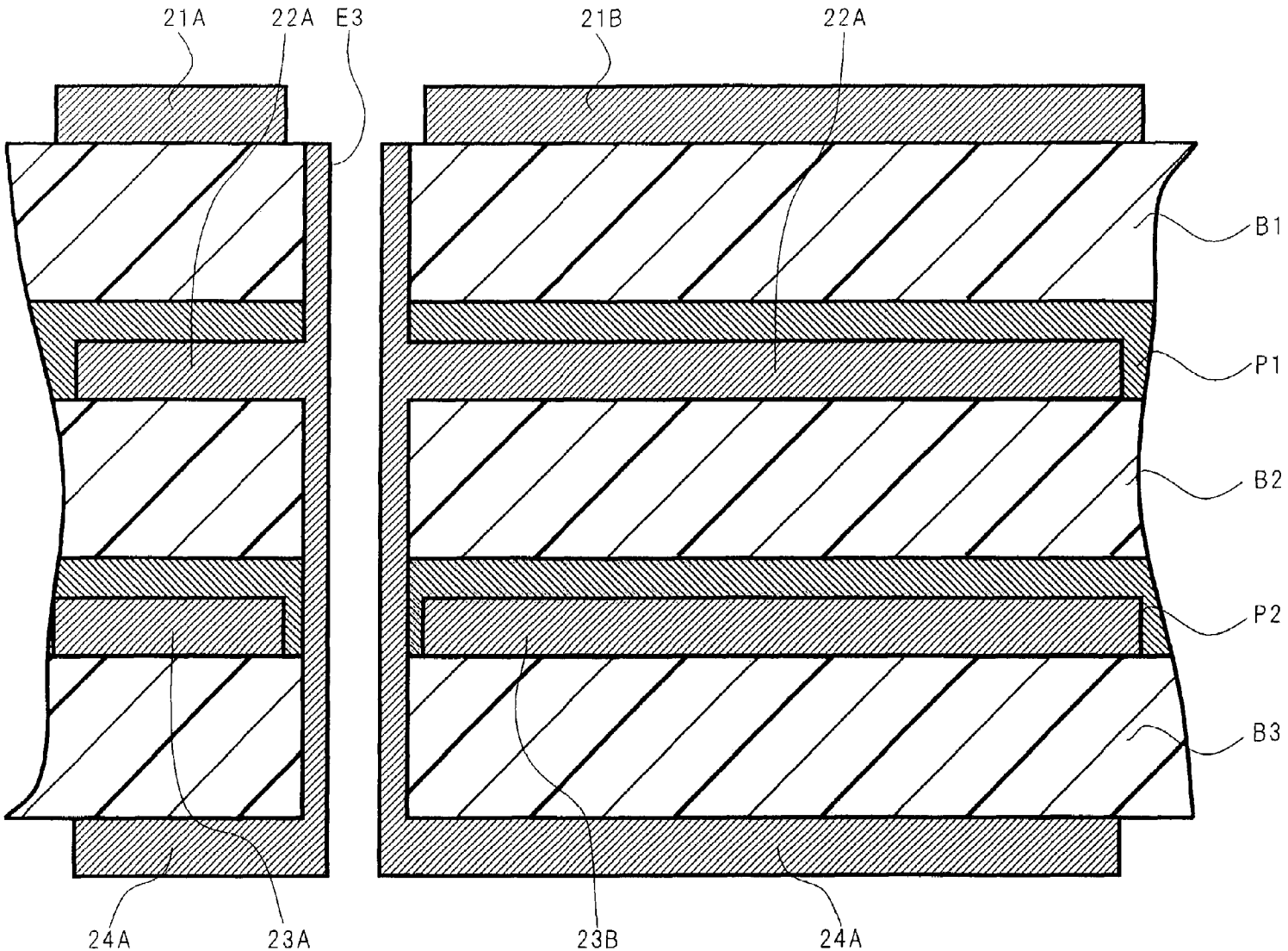
FIG. 9 is a sectional view of the second circuit board 50, taken along line IX-IX shown in FIG. 7.
Figure 10:
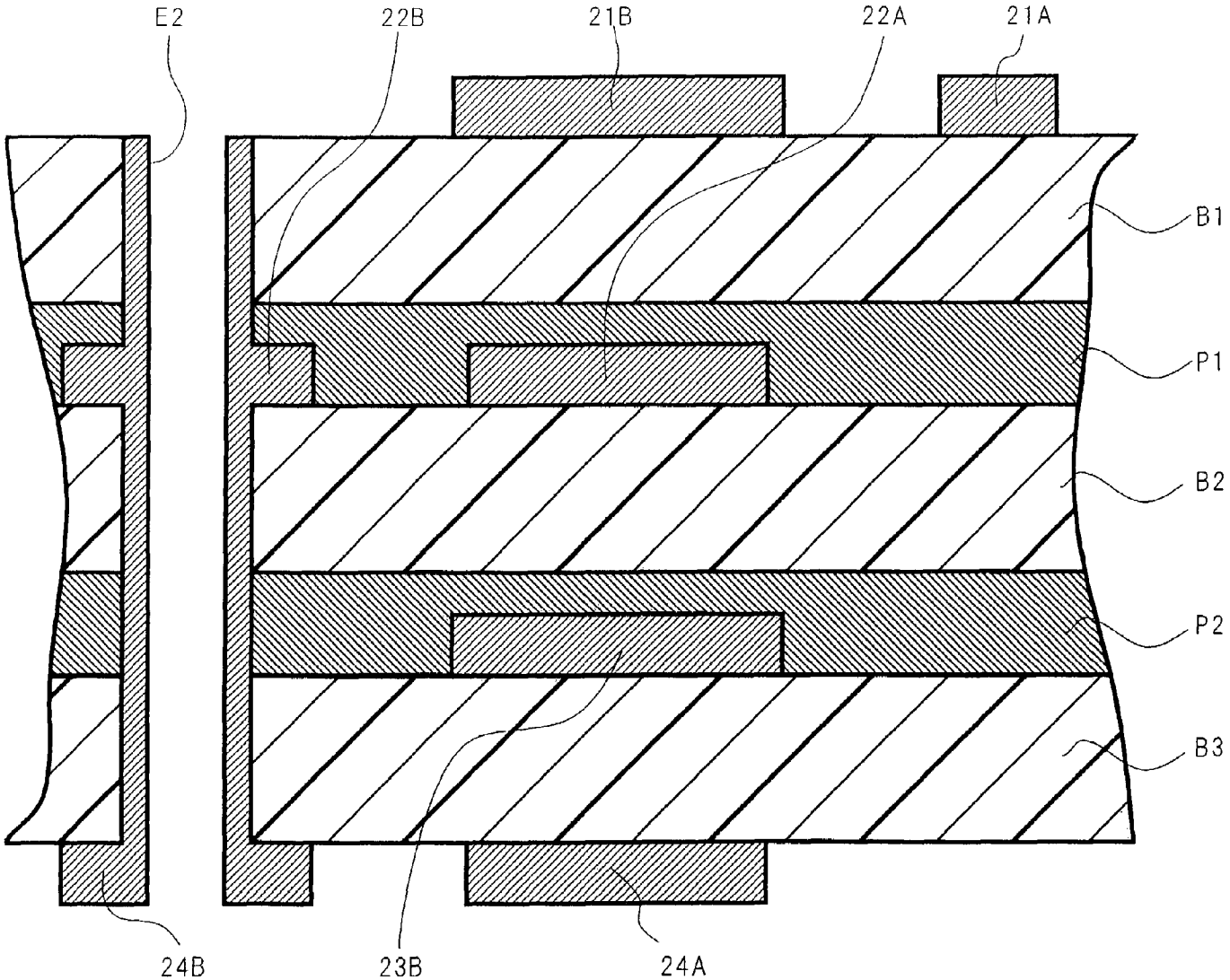
FIG. 10 is a sectional view of the second circuit board 50, taken along line X-X shown in FIG. 7.

In the areas where the first foils 21A, 22A, 23A and 24A of the first to forth conductor layers are overlapped, the first ballast capacitor CB1 is composed of the capacitance among the foils (See shaded parts CB1 shown in FIG. 7, and see FIGS. 8 and 9). The first ballast capacitor CB1 is substantially equivalent to a parallel connection of main three inter-foil capacitances, that is, a capacitance between the first and second conductor layers (21A and 22A), a capacitance between the second and third conductor layers (22A and 23A), and a capacitance between the third and fourth conductor layers (23A and 24A).

Figure 11:
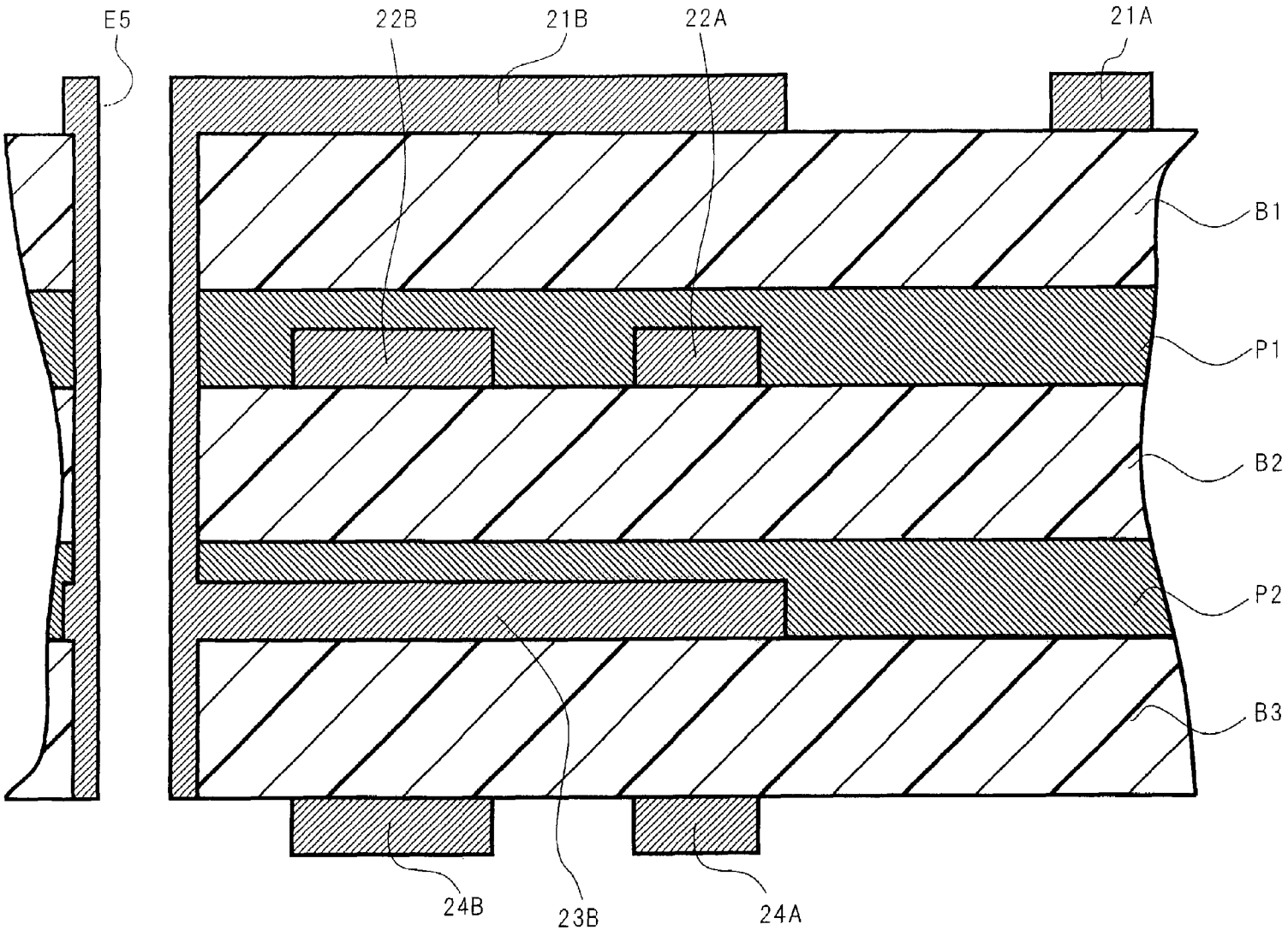
FIG. 11 is a sectional view of the second circuit board 50, taken along line XI-XI shown in FIG. 7.

In a manner similar to above, in the areas where the second foils 21B and 23B and the first foils 22A and 24A are overlapped, the second ballast capacitor CB2 is composed (See a shaded part CB2 shown in FIG. 7, and see FIGS. 9 and 10), and in the areas where the second foils 21B, 22B, 23B and 24B are overlapped, the third ballast capacitor CB3 is composed (See a shaded part CB3 shown in FIG. 7, and see FIG. 11). In this way, each of the three ballast capacitors CB1, CB2 and CB3 is configured as a so-called comb capacitor.

Capacitance of each of the ballast capacitors CB1 to CB3 is approximately several [pf], and the capacitance is adjustable depending on the overlapping area of the foils, the thicknesses of the core members B1 to B3 and the thickness of the prepregs P1 and P2, for example. In addition, the respective capacitances of the ballast capacitors CB1 to CB3 can be changed significantly by increasing or decreasing a number of layers in the multi-layer structure shown in FIGS. 8 to 11, for example. For example, the capacitance of the first ballast capacitor CB1 is approximately three times the capacitance between the third and fourth conductor layers (23A and 24A).

In the above-mentioned pattern, the respective first foils 21A and 23A of the first and third conductor layers are connected to the first block 1. On the other hand, the respective second foils 22B and 24B of the second and fourth conductor layers are connected to the first electrode 20A of each of the cold-cathode tubes 20.

For example, the stray capacitance between a conductor layer and the outside is smaller as the conductor layer is farther away from the outside of the second circuit board 50, particularly from the case 10. Accordingly, in the above-mentioned connection between the conductor layer of the second circuit board 50 and the first electrode 20A of each of the cold-cathode tubes 20, the electric potential of the first electrode 20A is less affected by the stray capacitance between the conductor layer and the outside. On the other hand, the output of the first block 1 is stable, regardless of the magnitude of load, more particularly, the magnitude of the stray capacitance between the conductor layer and the outside.

Thus, since changes in the electric potential of the first electrodes 20A hardly varies among the plurality of cold-cathode tubes 20, the uniformity of the tube current is further improved, and this leads to a further improved uniformity of the luminance.

Instead of the pattern shown in FIGS. 7 to 11, the following pattern may also be used for the conductor layers inside the second circuit board 50.

Figure 12:
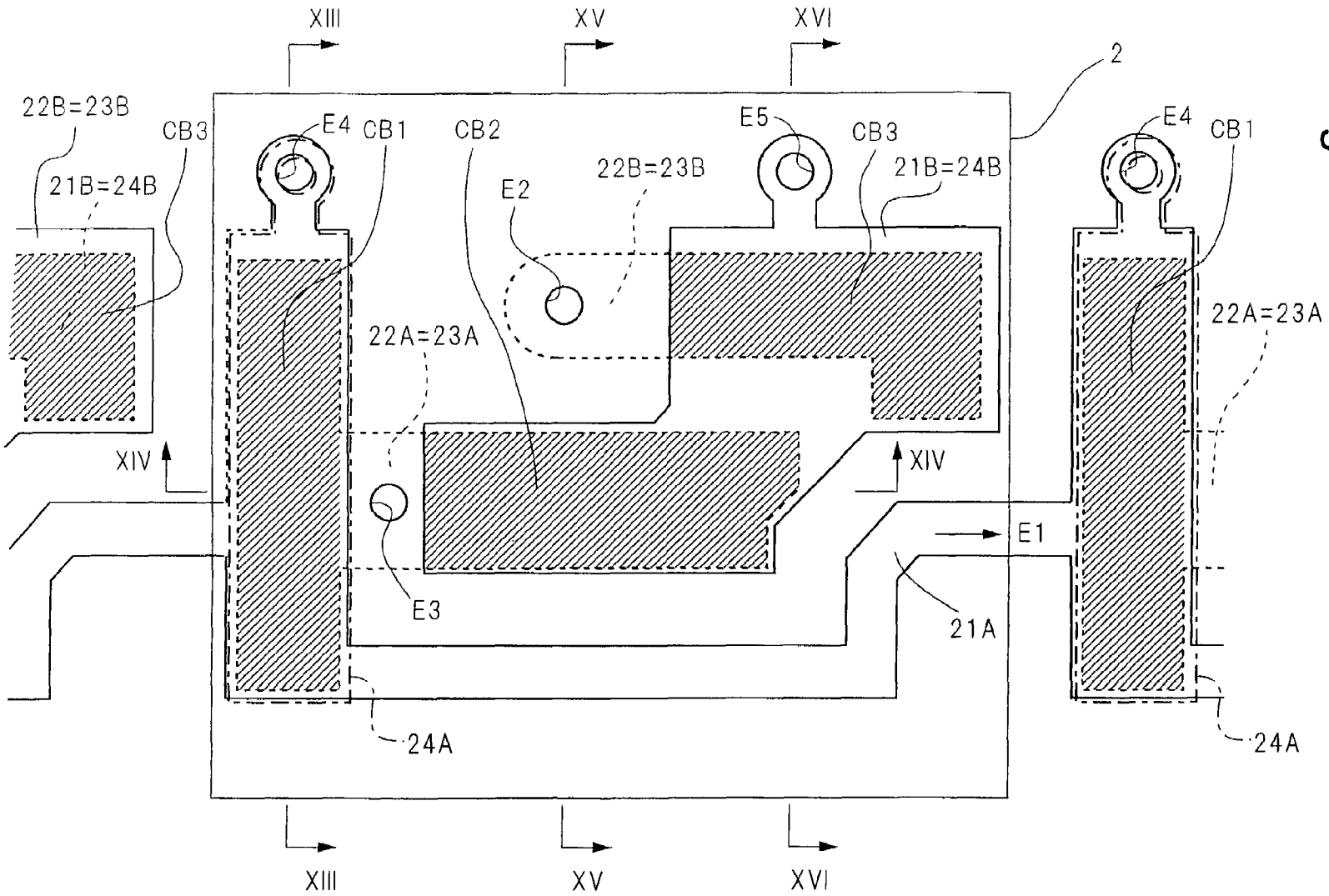
FIG. 12 is a plan view showing another pattern for the conductor layers inside the second circuit board 50 constituting the second block 2 in the cold-cathode tube lighting device according to the first preferred embodiment of the present invention.

FIG. 12 is a plan view showing another preferable pattern for the conductor layers inside the second circuit board 50. In FIG. 12, the two foils 21A and 21B of the first conductor layer are indicated by solid lines, and the first foil 24A of the fourth conductor layer is indicated by a long and short dash line. On the other hand, the second foil 24B of the fourth conductor layer is indicated by the same solid line as that for the second foil 21B of the first conductor layer. Further, the respective two foils, 22A and 23A and 22B and 23B, of the second and third conductor layers are indicated by the same broken lines, respectively.

FIGS. 13 to 16 are sectional views showing the second circuit board 50, taken along line XIII-XIII, line XIV-XIV, straight line XV-XV and line XVI-XVI, respectively (the arrows shown in FIG. 12 show visual line directions). In FIGS. 13 to 16, the dimensions in the vertical direction (the direction in the thickness of the circuit board) are made larger than those in the horizontal direction.

The second circuit board 50 includes foils 21A and 21B of the first conductor layer, the foils 22A and 22B of the second conductor layer, the foils 24A and 24B of the third conductor layer, and foils 24A and 24B of the fourth conductor layer (See FIGS. 13 to 16) in this order from the surface of the case 10 (See FIGS. 1 and 2). In FIGS. 13 to 16, the cross section of the second circuit board 50 is shown with the surface of the case 10 facing upward.

The first and fourth conductor layers have similar patterns. In addition, the first and fourth conductor layers include the first foils 21A and 24A having similar shapes, respectively, at the same positions as viewed in the direction normal to the surfaces of the foils. Further, the first and fourth conductor layers include the second foils 21B and 24B having the same shape, respectively, at the same positions as viewed in the direction normal to the surfaces of the foils (See FIG. 12). Unlike the first foil 21A of the first conductor layer, as for the first foil 24A of the fourth conductor layer, the first foils 24A of adjoining second blocks 2 are separated from each other. The first foils 21A and 24A are connected to each other via the fourth through hole E4 (See FIGS. 12 and 13), and the second foils 21B and 24B are connected via the fifth through hole E5 (See FIGS. 12 and 16).

The second and third conductor layers have the same pattern. In addition, the second and third conductor layers include the first foils 22A and 23A having the same shape, respectively, at the same positions as viewed in the direction normal to the surfaces of the foils. Further, the second and third conductor layers include the second foils 22B and 23B having the same shape, respectively, at the same positions as viewed in the direction normal to the surfaces of the foils (See FIG. 12). The first foils 22A and 23A are connected via the third through hole E3 (See FIGS. 12 and 14), and the second foils 22B and 23B are connected via the second through hole E2 (See FIGS. 12 and 15).

Figure 13:
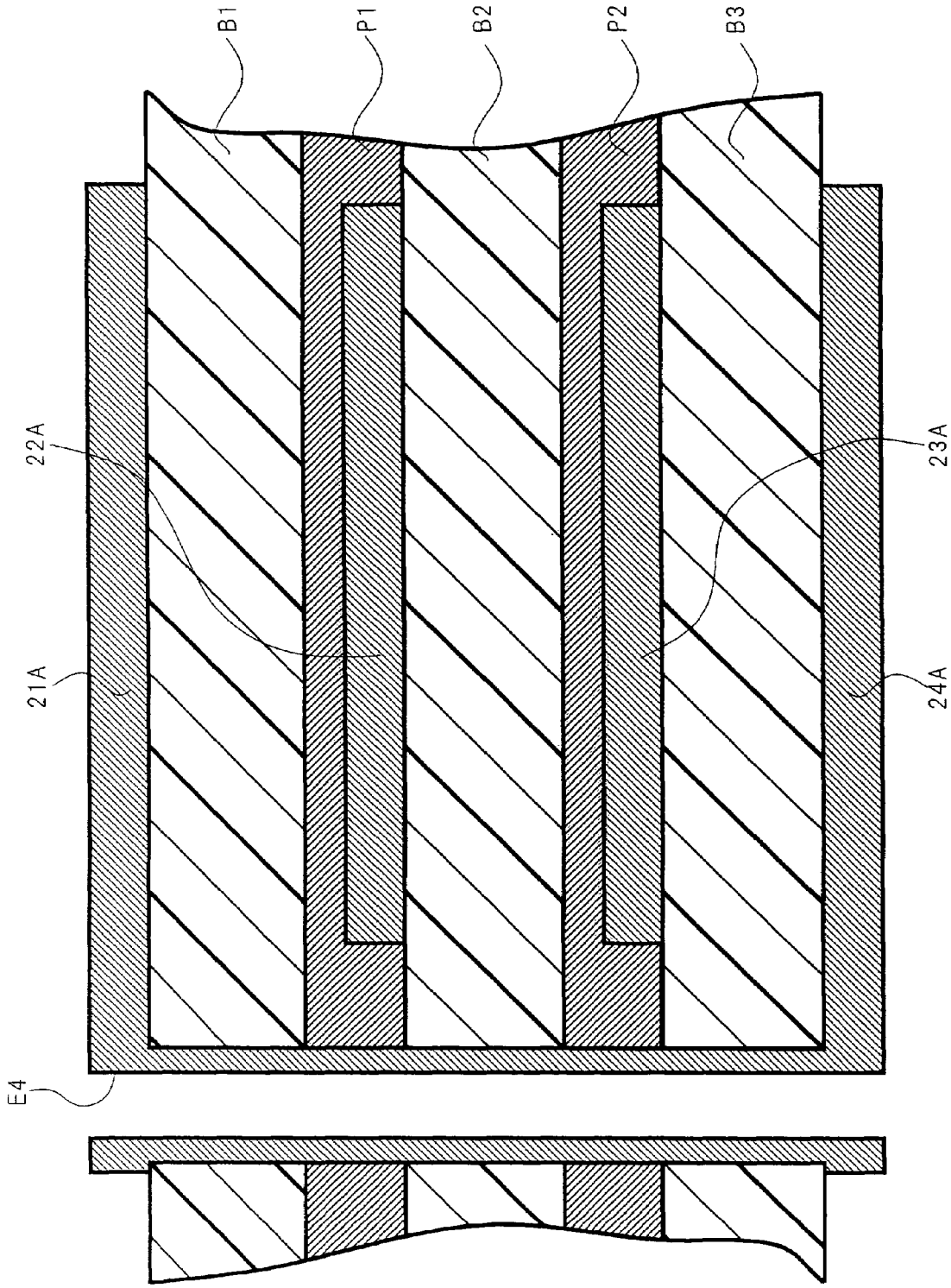
FIG. 13 is a sectional view of the second circuit board 50, taken along line XIII-XIII shown in FIG. 12.
Figure 14:
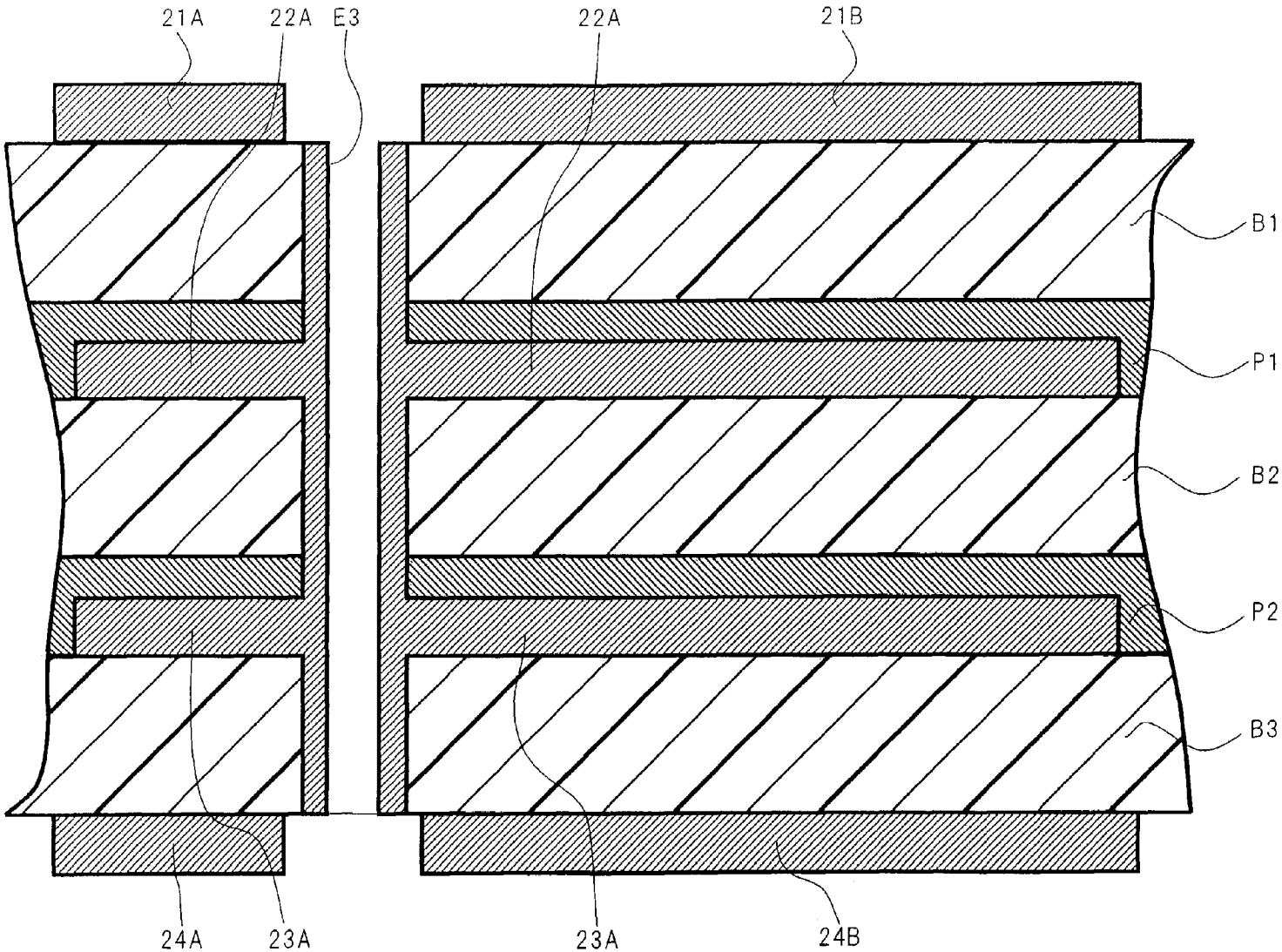
FIG. 14 is a sectional view of the second circuit board 50, taken along line XIV-XIV shown in FIG. 12.
Figure 15:
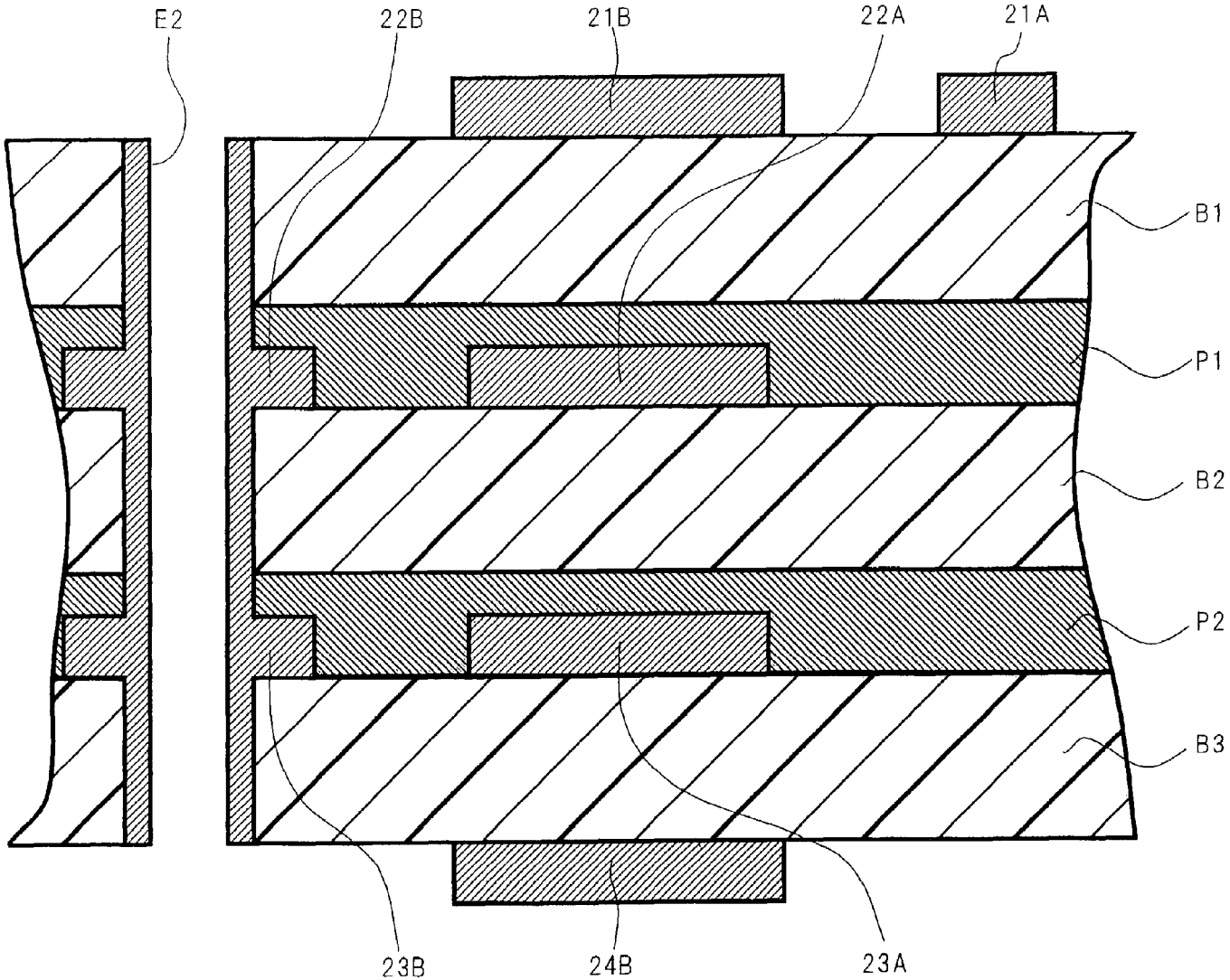
FIG. 15 is a sectional view of the second circuit board 50, taken along line XV-XV shown in FIG. 12.

In the areas where the first foils 21A, 22A, 23A and 24A of the first to fourth conductor layers are overlapped, the first ballast capacitor CB1 is composed of the capacitance among the foils (See the shaded parts CB1 shown in FIG. 12, and see FIGS. 13 and 14). However, unlike the above descriptions (See FIGS. 8 and 9), the first ballast capacitor CB1 is substantially equivalent to the parallel connection of main two inter-foil capacitances, that is, the capacitance between the first and second conductor layers (21A and 22A) and the capacitance between the third and fourth conductor layers (23A and 24A).

Figure 16:
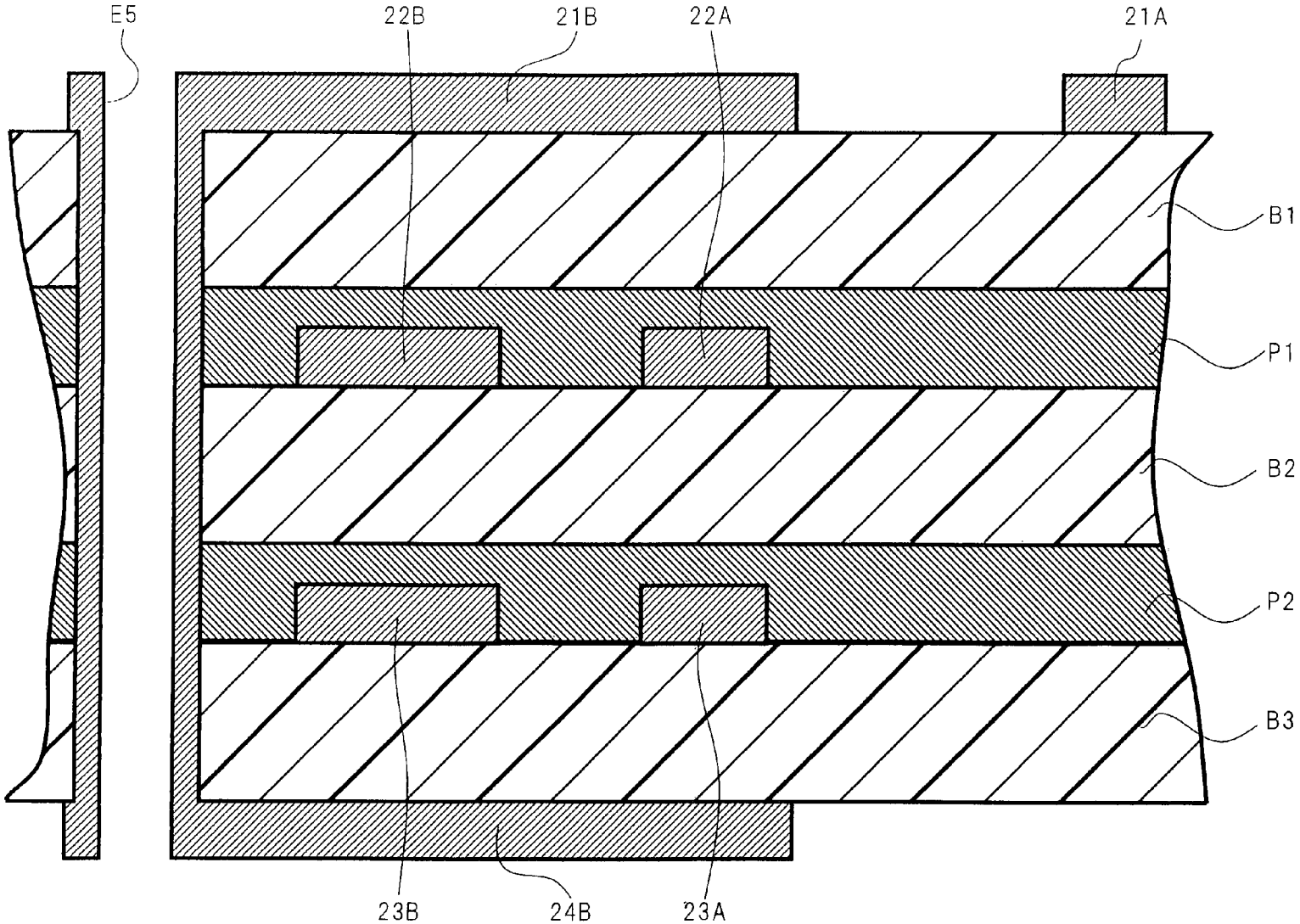
FIG. 16 is a sectional view of the second circuit board 50, taken along line XVI-XVI shown in FIG. 12.

In a manner similar to above, in the areas where the first foils 22A and 23A and the second foil 21B and 24B are overlapped, the second ballast capacitor CB2 is composed (See the shaded part CB2 shown in FIG. 12, and see FIGS. 14 and 15), and in the areas where the second foils 21B, 22B, 23B and 24B are overlapped, the third ballast capacitor CB3 is composed (See the shaded part CB3 shown in FIG. 12, and see FIG. 16).

The respective capacitances of the ballast capacitors CB1 to CB3 are slightly smaller in this pattern, unlike the case of the pattern described above. For example, the capacitance of the first ballast capacitor CB1 is approximately two times the capacitance between the third and fourth conductor layers (23A and 24A).

In this pattern, the respective first foils 21A and 24A of the first and fourth conductor layers are connected to the first block 1. On the other hand, the respective second foils 22B and 23B of the second and third conductor layers are connected to the first electrode 20A of the each of the cold-cathode tubes 20.

Since the second and third conductor layers are farther away from the surfaces of the second circuit board 50 than the first and fourth conductor layers, the stray capacitance between the second conductor layers and the cold-cathode tube 20, and the stray capacitance between the third conductor layers and the cold-cathode tube 20 are small, like the stray capacitance between the second conductor layers and the case 10, and the stray capacitance between the third conductor layers and the case 10. Accordingly, in the above-mentioned connection between the conductor layer of the second circuit board 50 and the first electrode 20A of each of the cold-cathode tubes 20, the electric potential of the first electrode 20A is much less affected by the stray capacitance between the conductor layer and the outside.

Thus, since changes in the electric potential of the first electrode 20A hardly varies among the plurality of cold-cathode tubes 20, the uniformity of the tube current is further improved, and this leads to a further improved uniformity of the luminance.

The three ballast capacitors CB1 to CB3 are further connected in series to each other across the input terminal E1 and the output terminal E2 of the second block 2 (See FIGS. 6 and 7). Accordingly, the whole series connection of the ballast capacitors is higher in withstand voltage than each of the ballast capacitors CB1 to CB3.

In this case, the number of the ballast capacitors being connected in series to each other can be changed easily to a number other than three by changing the pattern of the conductor layers from that described above. Namely, the number is optimized easily depending on the withstand voltage required for the whole of the ballast capacitors.

The third block 3 includes connection part to the second electrode 20B of the cold-cathode tube 20 (See FIG. 3). For example, the same conductor layer inside the third circuit board 60 are connected to the respective second electrodes 20B of the cold-cathode tubes 20, and the conductor layer is further connected to a grounding conductor provided outside.

One terminal of the secondary winding 52 of the step-up transformer 5 is connected to the respective first electrodes 20A of the cold-cathode tubes 20 via the respective second blocks 2. The other terminal of the secondary winding 52 is grounded. The respective second electrodes 20B of the cold-cathode tubes 20 are grounded via the third blocks 3.

Various stray capacitances are present (not shown) in the periphery of each of the cold-cathode tubes 20. The stray capacitances include the stray capacitance SC (See FIG. 2) between the cold-cathode tubes 20 and the case 10, and the stray capacitances of the wires for connecting the first block 1, the second block 2, the cold-cathode tubes 20, the third block 3 and the grounding conductor, for example. Accordingly, the stray capacitances in the periphery of the cold-cathode tubes 20 are different from each other for each of the cold-cathode tubes 20. For example, the total of their stray capacitances is several [pf].

The whole capacitance of the ballast capacitors CB1 to CB3 is adjusted for each second block 2, that is, for each of the cold-cathode tubes 20. In the adjustment, the differences in the installation conditions (for example, wire length or pattern, the distance between the tube wall and the case 10, and the like) among the plurality of cold-cathode tubes 20 are considered in particular.

For example, among the plurality of cold-cathode tubes 20, in the tube nearest to the side face of the case 10, the stray capacitance SC between the tube wall thereof and the side face of the case 10 is larger. Accordingly, the whole capacitance of the ballast capacitors CB1 to CB3 connected to one cold-cathode tube nearest to the side face of the case 10 among the cold-cathode tubes 20 is set at a larger value.

Accordingly, in each combination of each of the cold-cathode tubes 20 and the second block 2, the whole capacitance of the ballast capacitors CB1 to CB3 substantially coincides with the stray capacitances in the periphery of each of the cold-cathode tubes 20. Namely, the whole impedance of the ballast capacitors CB1 to CB3 is matched with the combined impedance of the stray capacitance in the periphery of each of the cold-cathode tubes 20.

In this case, since the first block 1 is low in output impedance, the impedance matching described above is attained easily.

Further preferably, the whole impedance of the ballast capacitors CB1 to CB3 is set so as to be matched with the impedance of each of the cold-cathode tubes 20 during lighting.

In the cold-cathode tube lighting device according to the first preferred embodiment of the present invention, the output impedance of the step-up transformer 5 is suppressed as described above, contrary to the presumption in the device according to the prior art. Instead, the series connection of the ballast capacitors CB1 to CB3 is connected as one set to each of the cold-cathode tubes 20. In particular, the impedances of the series connections are set independently so as to cancel out the differences of the peripheral stray capacitances among the plurality of cold-cathode tubes 20. Accordingly, since no variation occurs in tube current among the plurality of cold-cathode tubes 20, the luminance is maintained uniformly.

Accordingly, the cold-cathode tube lighting device according to the first preferred embodiment of the present invention uniformly lights the plurality of cold-cathode tubes 20 using the common low-impedance power source (first block) 1. In addition, since the wires connected among the first block 1, the second block 2 and the third block 3 may be long and may be different significantly for each of the cold-cathode tubes 20, the layout of the wiring is high in flexibility. Accordingly, the downsizing of the whole device is realized easily.

Further, in the cold-cathode tube lighting device according to the first preferred embodiment of the present invention, the ballast capacitors CB1 to CB3 are each composed of the capacitances among the conductor layers inside the second circuit board 50 as described above. Accordingly, since the ballast capacitors CB1 to CB3 are wholly embedded inside the second circuit board 50, the connection parts to the cold-cathode tubes 20 are very thin (See FIG. 2). Accordingly, in the cold-cathode tube lighting device according to the first preferred embodiment of the present invention, the use of the ballast capacitors CB1 to CB3 is extremely effective in thinning liquid crystal displays.

Second Preferred Embodiment

A cold-cathode tube lighting device according to a second preferred embodiment of the present invention is installed in a liquid crystal display, in a manner similar to that of the device according to the first preferred embodiment described above. Since a configuration of the liquid crystal display is similar to that according to the first preferred embodiment described above, FIGS. 1 and 2, and the descriptions in the first preferred embodiment described above are incorporated to describe the configuration.

Figure 17:
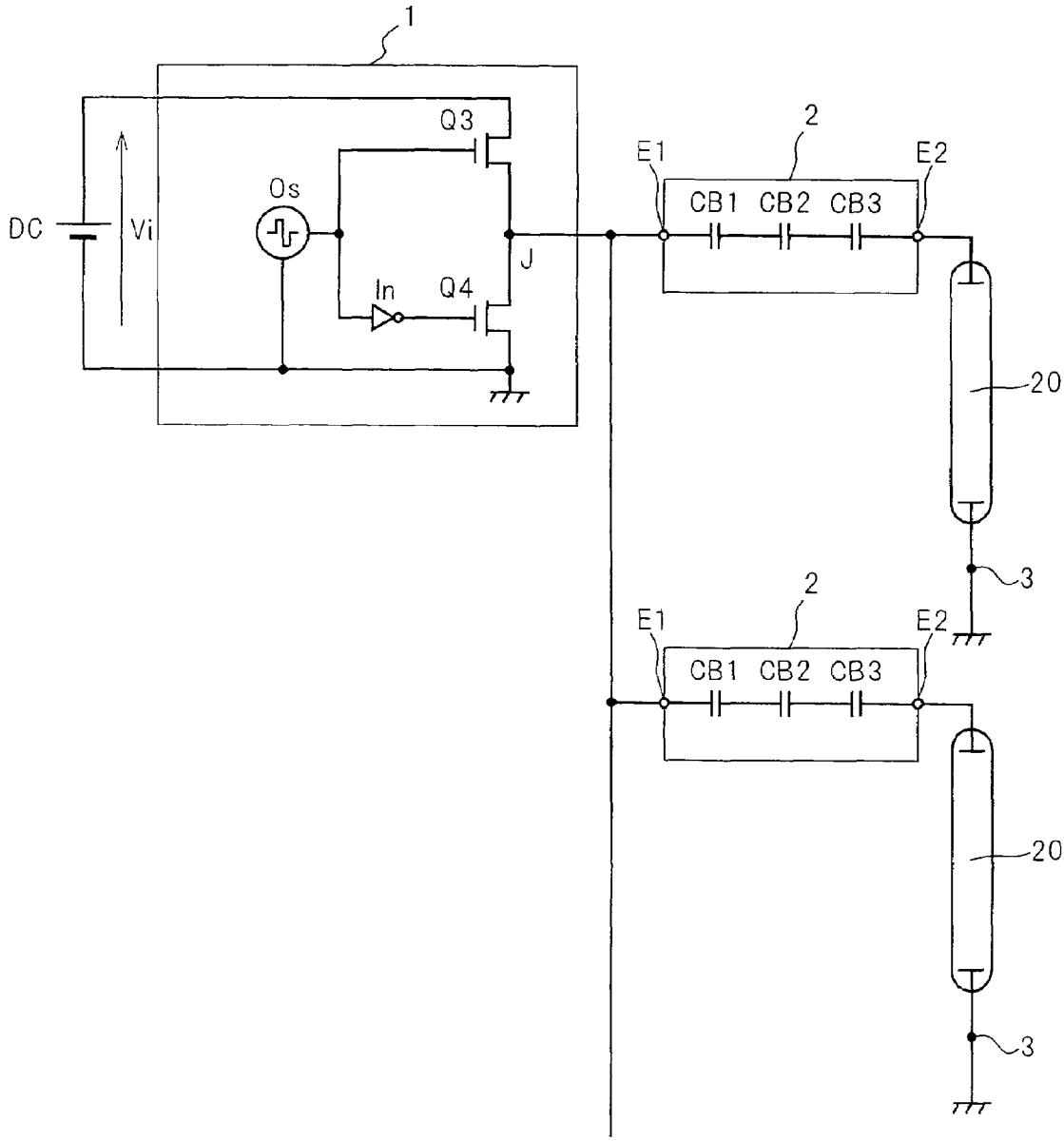
FIG. 17 is a circuit diagram showing a configuration of a cold-cathode tube lighting device according to a second preferred embodiment of the present invention.

FIG. 17 is a circuit diagram showing a configuration of the cold-cathode tube lighting device according to the second preferred embodiment of the present invention. The cold-cathode tube lighting device has components similar to the components (See FIG. 3) of the device according to the first preferred embodiment, except for the configuration of the first block 1. Accordingly, the similar components are designated by the same numerals shown in FIG. 3, and the descriptions in the first preferred embodiment are incorporated to describe them.

The first block 1 includes an oscillator Os, a high-side power transistor Q3, a low-side power transistor Q4, and an inverter In.

The positive electrode of the direct-current power source DC is connected to one terminal of the high-side power transistor Q3, and the negative electrode thereof is grounded. The other terminal of the high-side power transistor Q3 is connected to one terminal of the low-side power transistor Q4, and the other terminal of the low-side power transistor Q4 is grounded. The high-side power transistor Q3 and the low-side power transistor Q4 are preferably MOS FETs. In addition, they may be IGBTs or bipolar transistors.

The oscillator Os is directly connected to a control terminal of the high-side power transistor Q3, and the oscillator Os is connected to a control terminal of the low-side power transistor Q4 via the inverter In.

The connection point "J" of the two power transistors Q3 and Q4 is connected to each terminal of each of the cold-cathode tubes 20 via each second block 2.

The direct-current power source DC maintains its output voltage Vi at a constant value (for example, 1400 [V]). The oscillator Os outputs a pulse wave having a constant frequency (for example, 45 [kHz]) to the control terminals of the two power transistors Q3 and Q4. The inverter In changes the polarity of the pulse wave inputted to the control terminal of the low-side power transistor Q4 so as to be opposite to the polarity of the pulse wave inputted to the control terminal of the high-side power transistor Q3. Accordingly, the two power transistors Q3 and Q4 are turned on and off alternately at the same frequency as the frequency of the oscillator Os. Accordingly, the electric potential of the connection point "J" has either Vi or the ground potential (nearly zero) alternately.

Thus, the first block 1 converts the output voltage Vi of the direct-current power source DC into an alternating-current voltage having a high frequency (for example, 45 [kHz]).

Since an output stage of the first block 1 is constructed by the power transistors Q3 and Q4 as described above, an output impedance of the first block 1 is low. Namely, in the cold-cathode tube lighting device according to the second preferred embodiment of the present invention, in a manner similar to that of the device according to the first preferred embodiment described above, the first block 1 functions as a low-impedance power source. Accordingly, in a manner similar to that of the setting in the first preferred embodiment, the luminance is maintained uniformly among the plurality of cold-cathode tubes 20 by setting the whole impedance of ballast capacitors CB1 to CB3 for each of the cold-cathode tubes 20.

Thus, the cold-cathode tube lighting device according to the second preferred embodiment of the present invention uniformly lights the plurality of cold-cathode tubes 20 using the common low-impedance power source (first block) 1. In addition, since the wires connected among the first block 1, the second block 2 and the third block 3 may be long and may be different significantly for each of the cold-cathode tubes 20, the layout of the wiring is high in flexibility. Accordingly, the downsizing of the whole device is realized easily.

Further, in the cold-cathode tube lighting device according to the second preferred embodiment of the present invention, the ballast capacitors CB1 to CB3 are each composed of the capacitances among the conductor layers inside the second circuit board 50 as described above. Accordingly, since the ballast capacitors CB1 to CB3 are wholly embedded inside the second circuit board 50, the connection parts to the cold-cathode tubes 20 are very thin (See FIG. 2). Accordingly, in the cold-cathode tube lighting device according to the second preferred embodiment of the present invention, the use of the ballast capacitors CB1 to CB3 is extremely effective in thinning liquid crystal displays.

Third Preferred Embodiment

A cold-cathode tube lighting device according to a third preferred embodiment of the present invention is installed in a liquid crystal display, in a manner similar to that of the device according to the first preferred embodiment described above. Since a configuration of the liquid crystal display is similar to that according to the first preferred embodiment described above, FIG. 1, FIG. 2 and the descriptions in the first preferred embodiment described above are incorporated to describe the configuration.

Figure 18:
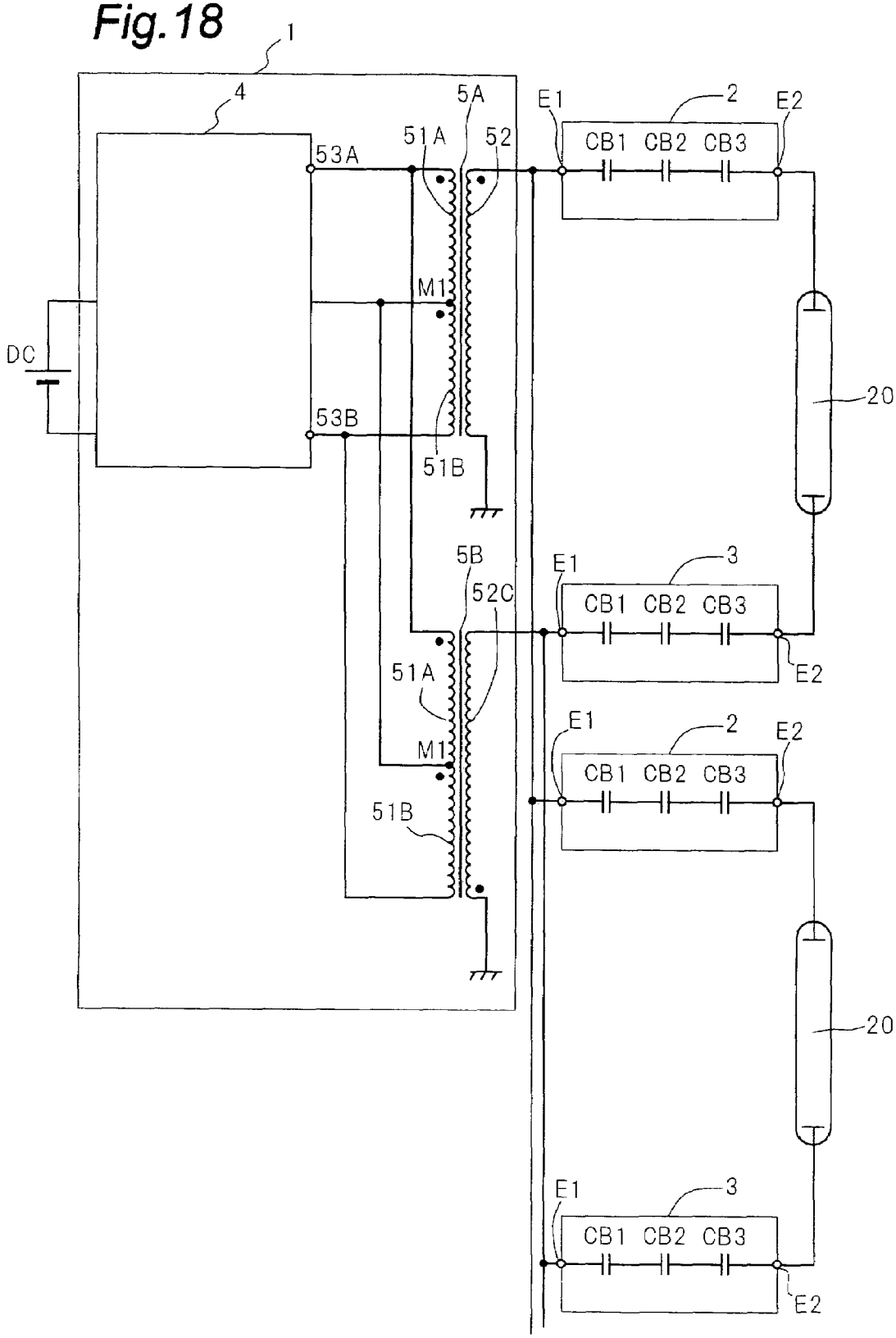
FIG. 18 is a circuit diagram showing a configuration of a cold-cathode tube lighting device according to a third preferred embodiment of the present invention.

FIG. 18 is a circuit diagram showing a configuration of the cold-cathode tube lighting device according to the third preferred embodiment of the present invention. The cold-cathode tube lighting device has components similar to the components (See FIG. 3) of the device according to the first preferred embodiment, except for the configurations of the first block 1 and the third block 3. Accordingly, the similar components are designated by the same numerals shown in FIG. 3, and the descriptions in the first preferred embodiment are incorporated to describe them.

In the cold-cathode tube lighting device according to the third preferred embodiment of the present invention, unlike the case of the device according to the first preferred embodiment described above, the first block 1 has two step-up transformers 5A and 5B, and the third block 3 has a series connection of three ballast capacitors CB1 to CB3, in a manner similar to that of the second block 2.

Generally speaking, in each of the cold-cathode tubes 20, the stray capacitance SC (See FIG. 2) is generated between the case 10 (or the reflecting plate 30) grounded and the tube wall. In such a configuration that one of the electrodes of the each of the cold-cathode tubes 20 is grounded in a manner similar to that of the cold-cathode tube lighting device according to the first preferred embodiment described above, only the electric potential of the other electrode varies significantly with respect to the electric potential (equal to the ground potential) of the case 10. Accordingly, when the stray capacitance SC between the case 10 and the tube wall is excessive, the leakage current flowing between the tube wall and the case 10 increases excessively in the vicinity of the other electrode described above, in particular. The cold-cathode tubes 20 installed as the backlight of a liquid crystal display is particularly long. Accordingly, the excessive increase of the leakage current may impair the uniformity of the tube current in the longitudinal direction. As a result, an imbalance in luminance may occur in the longitudinal direction of each of the cold-cathode tubes 20.

In order to further raise the uniformity of the luminance in the longitudinal direction, an intermediate point of the electrode potentials at both ends of each of the cold-cathode tubes 20 should be maintained at the ground potential. In this case, the electrode potentials at both ends are maintained asymmetrically with respect to the ground potential (the electric potential of the case 10). Namely, the electrode potentials at both ends vary uniformly with respect to the ground potential (the electric potential of the case 10). Accordingly, in each of the cold-cathode tubes 20, the distribution of the leakage current flowing between each part of tube wall and the case 10 is symmetrical with respect to the central part of the cold-cathode tube 20. Accordingly, in each of the cold-cathode tubes 20, the imbalance in luminance in the longitudinal direction of each of the cold-cathode tubes 20 is reduced, and this leads to the improved uniformity.

Further, when the intermediate point of the electrode potentials at both ends of the each of the cold-cathode tubes 20 is maintained at the ground potential, the amplitude of the electrode potential with respect to the ground potential is halved while the amplitude of the voltage across both ends of the each of the cold-cathode tubes 20 is maintained, unlike the case where the electrodes at one end of the cold-cathode tubes 20 are grounded. Accordingly, since the leakage current is reduced, the imbalance of the distribution of the leakage current is reduced. Accordingly, the imbalance in luminance in the longitudinal direction of each of the cold-cathode tubes 20 is further reduced, and this leads to the further improved uniformity.

Each of the two step-up transformers 5A and 5B has a configuration similar to that of the step-up transformer 5 (See FIGS. 4 and 5) according to the first preferred embodiment described above, and the leakage current thereof is particularly small.

One terminal of the secondary winding 52 of the first step-up transformer 5A is connected to each electrode at one end of each of the cold-cathode tubes 20 via each second block 2. The other terminal of the secondary winding 52 is grounded.

One terminal of the secondary winding 52C of the second step-up transformer 5B is connected to each electrode at the other end of each of the cold-cathode tubes 20 via each third block 3. The other terminal of the secondary winding 52C is grounded.

In this case, the respective secondary windings 52 and 52C of the two step-up transformers 5A and 5B are connected so that their polarities are opposite to each other. Accordingly, the electrode potentials at both ends of the each of the cold-cathode tubes 20 vary so as to be opposite to each other in phase.

In addition, the step-up ratio of each of the step-up transformers 5A and 5B is set so that the effective value of the secondary voltage of each of the step-up transformers 5A and 5B is preferably approximately half of the lamp voltage of the cold-cathode tubes 20. For example, when the lamp voltage of the cold-cathode tubes 20 is 1000 [V], the effective value of the secondary voltage is preferably set at approximately 700 [V].

The third circuit board 60 has a multi-layer structure similar to that of the second circuit board 50 according to the first preferred embodiment described above (See FIGS. 8 to 11 and FIGS. 13 to 16). In addition, the third block 3 includes the series connection of three ballast capacitors CB1, CB2 and CB3 (See FIG. 18), in a manner similar to that of the second block 2, for example. In a manner similar to that of the ballast capacitors CB1 to CB3 according to the first preferred embodiment described above, each of the ballast capacitors CB1, CB2 and CB3 is composed of the capacitances among the conductor layers inside the third circuit board 60 (See FIGS. 6 to 11 and FIGS. 13 to 16). In this case, since the number of capacitors being connected in series is determined by the relationship between the withstand voltage among the conductor layers and the withstand voltage required for the whole of the capacitors, the number may be other than three. The modification of the number is done easily as described later.

The whole capacitance of the ballast capacitors CB1 to CB3 is adjusted for each third block 3. In the adjustment, the differences in the installation conditions (for example, wire length or pattern, the distance between the tube wall and the case 10, etc.) among the plurality of cold-cathode tubes 20 are considered in particular.

For example, among the plurality of cold-cathode tubes 20, in the tube nearest to the side face of the case 10, the stray capacitance SC between the tube wall thereof and the side face of the case 10 is larger. Accordingly, the whole capacitance of the ballast capacitors CB1 to CB3 connected to a cold-cathode tube nearest to the side face of the case 10 among the cold-cathode tubes 20 is set at a larger value.

Accordingly, in each combination of each of the cold-cathode tubes 20 and the third block 3, the whole capacitance of the ballast capacitors CB1 to CB3 substantially coincides with the stray capacitances in the periphery of each of the cold-cathode tubes 20. Namely, the whole impedance of the ballast capacitors CB1 to CB3 is matched with the combined impedance of the stray capacitance in the periphery of each of the cold-cathode tubes 20.

In this case, since the first block 1 is low in output impedance, the impedance matching described above is attained easily.

Further preferably, the whole impedance of the ballast capacitors CB1 to CB3 is set so as to be matched with the impedance of each of the cold-cathode tubes 20 during lighting.

In the cold-cathode tube lighting device according to the third preferred embodiment of the present invention, in a manner similar to that of the device according to the first preferred embodiment described above, the first block 1 functions as a low-impedance power source. Further, in this case, impedance matching is realized among the second block 2, the cold-cathode tube 20 (and stray capacitance in the periphery thereof) and the third block 3 for each of the cold-cathode tubes 20. As a result, the luminance is maintained uniformly among the plurality of cold-cathode tubes 20, in a manner similar to that of the first preferred embodiment described above.

Thus, the cold-cathode tube lighting device according to the third preferred embodiment of the present invention uniformly lights the plurality of cold-cathode tubes 20 using the common low-impedance power source (first block) 1. In addition, since the wires connected among the first block 1, the second block 2 and the third block 3 may be long and may be different significantly for each of the cold-cathode tubes 20, the layout of the wiring is high in flexibility. Accordingly, the downsizing of the whole device is realized easily.

In the cold-cathode tube lighting device according to the third preferred embodiment of the present invention, two separate step-up transformers, the transformers 5A and 5B, are installed. In particular, the respective secondary windings 52 and 52C of the two step-up transformers 5A and 5B are connected so that their polarities are opposite to each other. Accordingly, the electrode potentials at both ends of the each of the cold-cathode tubes 20 vary so as to be opposite to each other in phase, and in particular, the intermediate point of the electrode potentials at both ends is maintained at the ground potential. Accordingly, the uniformity in luminance in the longitudinal direction is further improved for each of the cold-cathode tubes 20.

Further, the withstand voltage of each of the step-up transformers 5A and 5B is halved from the withstand voltage of the step-up transformer 5 (See FIG. 3) according to the first preferred embodiment described above. Accordingly, each of the step-up transformers 5A and 5B is downsized more easily than the step-up transformer 5 (See FIG. 3) according to the first preferred embodiment. In particular, the height of the step-up transformers 5A and 5B can be made shorter than the height of the step-up transformer 5 (See FIG. 3) according to the first preferred embodiment. Accordingly, the cold-cathode tube lighting device according to the third preferred embodiment of the present invention is particularly advantageous in downsizing liquid crystal displays.

Further, in the cold-cathode tube lighting device according to the third preferred embodiment of the present invention, the ballast capacitors CB1 to CB3 are each composed of the capacitances among the conductor layers inside each of the second circuit board 50 and he third circuit board 60 as described above. Accordingly, since the ballast capacitors CB1 to CB3 are wholly embedded inside each of the second circuit board 50 and the third circuit board 60, the connection parts to the cold-cathode tubes 20 are very thin (See FIG. 2). Accordingly, in the cold-cathode tube lighting device according to the third preferred embodiment of the present invention, the use of the ballast capacitors CB1 to CB3 is extremely effective in thinning liquid crystal displays.

Fourth Preferred Embodiment

A cold-cathode tube lighting device according to a fourth preferred embodiment of the present invention is installed in a liquid crystal display, in a manner similar to that of the device according to the first preferred embodiment described above. Since a configuration of the liquid crystal display is similar to that according to the first preferred embodiment described above, FIGS. 1 and 2, and the descriptions in the first preferred embodiment described above are incorporated to describe the configuration.

Figure 19:
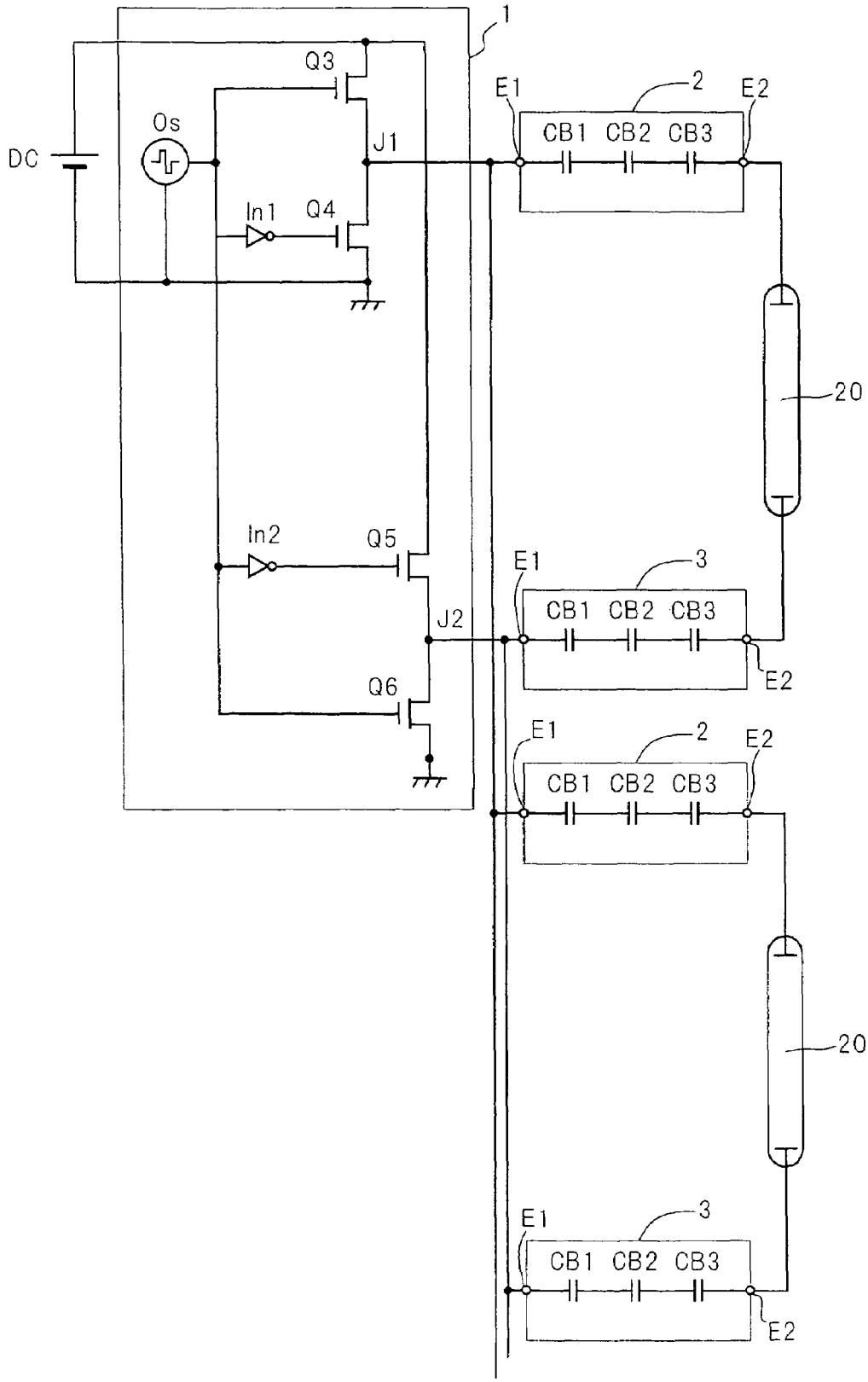
FIG. 19 is a circuit diagram showing a configuration of a cold-cathode tube lighting device according to a fourth preferred embodiment of the present invention.
Figure 20:
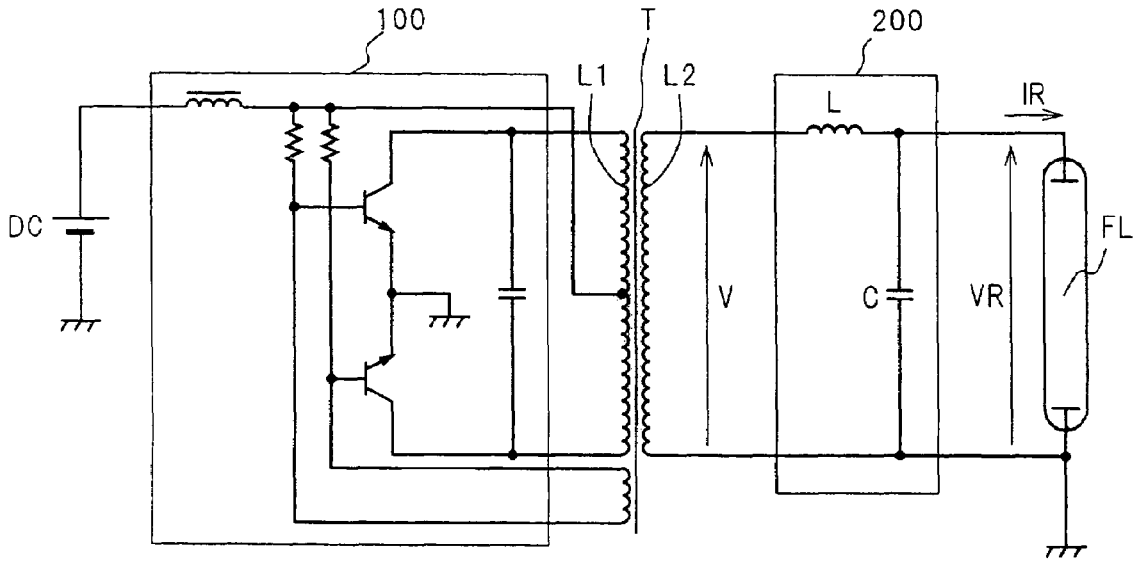
Fig.20 (PRIOR ART)
FIG. 20 is a circuit diagram showing a configuration of a cold-cathode tube lighting device according to a prior art.

FIG. 19 is a circuit diagram showing a configuration of the cold-cathode tube lighting device according to the fourth preferred embodiment of the present invention. The cold-cathode tube lighting device has components similar to the components (See FIG. 18) of the device according to the third preferred embodiment, except for the configuration of the first block 1. Accordingly, the similar components are designated by the same numerals shown in FIG. 18, and the descriptions in the third preferred embodiment are incorporated to describe them.

In the cold-cathode tube lighting device according to the fourth preferred embodiment of the present invention, unlike the case of the device according to the third preferred embodiment described above, the first block 1 has two pairs of series connections of two power transistors similar to those used in the first block 1 (See FIG. 17) according to the second preferred embodiment described above. The first block 1 further includes an oscillator Os and two inverters In1 and In2.

The positive electrode of the direct-current power source DC is connected to one terminal of each of two high-side power transistors Q3 and Q5, and the negative electrode thereof is grounded. The other terminal of the first high-side power transistor Q3 is connected to one terminal of the first low-side power transistor Q4, and the other terminal of the first low-side power transistor Q4 is grounded. The other terminal of the second high-side power transistor Q5 is connected to one terminal of the second low-side power transistor Q6, and the other terminal of the second low-side power transistor Q6 is grounded. The four power transistors Q3, Q4, Q5 and Q6 are preferably MOS FETs. In addition, they may be IGBTs or bipolar transistors.

The oscillator Os is directly connected to the control terminal of the first high-side power transistor Q3 and the control terminal of the second high-side power transistor Q6. On the other hand, the oscillator Os is connected to the control terminal of the first low-side power transistor Q4 via the first inverter In1, and connected to the control terminal of the second low-side power transistor Q5 via the second inverter In2.

The first connection point J1 of the first high-side power transistor Q3 and the first low-side power transistor Q4 is connected to each electrode at one end of each of the cold-cathode tubes 20 via each second block 2. The second connection point J2 of the second high-side power transistor Q5 and the second low-side power transistor Q6 is connected to each electrode at the other end of each of the cold-cathode tubes 20 via each third block 3.

The direct-current power source DC maintains its output voltage Vi at a constant value (for example, 700 [V]). The oscillator Os outputs a pulse wave having a constant frequency (for example, 45 [kHz]) to the control terminals of the four power transistors Q3, Q4, Q5 and Q6. The first inverter In1 changes the polarity of the pulse wave inputted to the control terminal of the first low-side power transistor Q4 so as to be opposite to the polarity of the pulse wave inputted to the control terminal of the first high-side power transistor Q3. In a manner similar to above, the second inverter In2 changes the polarity of the pulse wave inputted to the control terminal of the second high-side power transistor Q5 so as to be opposite to the polarity of the pulse wave inputted to the control terminal of the second low-side power transistor Q6. Accordingly, the first high-side power transistor Q3 and the second low-side power transistor Q6 are turned on and off together, and the first low-side power transistor Q4 and the second high-side power transistor Q5 are turned on and off together. Further, the high-side power transistors Q3 and Q5 are turned on and off alternately, and the low-side power transistors Q4 and Q6 are turned on and off alternately at the same frequency as the frequency of the oscillator Os. Accordingly, the electric potential of the first connection point J1 and the electric potential of the second connection point J2 vary so as to be opposite to each other in phase.

Thus, the first block 1 converts the output voltage Vi of the direct-current power source DC into an alternating-current voltage having a high frequency (for example, 45 [kHz]).

Since the output stage of the first block 1 includes the four power transistors Q3, Q4, Q5 and Q6 as described above, output impedance of the first block 1 is low. Namely, in the cold-cathode tube lighting device according to the fourth preferred embodiment of the present invention, in a manner similar to that of the device according to the third preferred embodiment described above, the first block 1 functions as a low-impedance power source. Accordingly, in a manner similar to that of the setting in the third preferred embodiment, the luminance is maintained uniformly among the plurality of cold-cathode tubes 20 by setting the whole impedance of the ballast capacitors CB1 to CB3 for each of the cold-cathode tubes 20.

Thus, the cold-cathode tube lighting device according to the fourth preferred embodiment of the present invention uniformly lights the plurality of cold-cathode tubes 20 using the common low-impedance power source (first block) 1. In addition, since the wires connected among the first block 1, the second block 2 and the third block 3 may be long and may be different significantly for each of the cold-cathode tubes 20, the layout of the wiring is high in flexibility. Accordingly, the downsizing of the whole device is realized easily.

In the cold-cathode tube lighting device according to the fourth preferred embodiment of the present invention, unlike the device according to the second preferred embodiment described above, two separate pairs of power transistors are installed. In addition, the output voltages of each pair of the power transistors are maintained so as to be opposite to each other in phase. Accordingly, the electrode potentials at both ends of each of the cold-cathode tubes 20 vary so as to be opposite to each other in phase, and in particular, the intermediate point of the electrode potentials at both ends is maintained at the ground potential. Accordingly, the uniformity in luminance in the longitudinal direction is further improved for each of the cold-cathode tubes 20.

Further, the withstand voltage of each of the power transistors Q3, Q4, Q5 and Q6 is halved from the withstand voltage of the power transistors according to the second preferred embodiment described above. Accordingly, this makes the configuration of the power transistors relatively easy.

Further, in the cold-cathode tube lighting device according to the fourth preferred embodiment of the present invention, the ballast capacitors CB1 to CB3 are each composed of the capacitances among the conductor layers inside each of the second circuit board 50 and he third circuit board 60 as described above. Accordingly, since the ballast capacitors CB1 to CB3 are wholly embedded inside each of the second circuit board 50 and the third circuit board 60, the connection parts to the cold-cathode tubes 20 are very thin (See FIG. 2). Accordingly, in the cold-cathode tube lighting device according to the fourth preferred embodiment of the present invention, the use of the ballast capacitors CB1 to CB3 is extremely effective in thinning liquid crystal displays.

INDUSTRIAL APPLICABILITY

The cold-cathode tube lighting device according to the present invention is installed, for example, as a backlight driving device in a liquid crystal display, adopts a low-impedance power source, and has ballast capacitors formed as capacitances among the conductor layers of circuit boards as described above. Accordingly, the present invention is obviously useful for industrial applications.

The invention claimed is:

1. A cold-cathode tube lighting device comprising:

a circuit board on which one end of each of a plurality of cold-cathode tubes is mounted, said circuit board including at least two conductor layers;

a plurality of ballast capacitors each having a capacitance between said two conductor layers, at least one of said ballast capacitors being connected to an electrode at the one end of each of said cold-cathode tubes; and a low-impedance power source having an output impedance lower than a combined impedance of said plurality of cold-cathode tubes, said low-impedance power source supplying electric power to said cold-cathode tubes via said ballast capacitors.

2. The cold-cathode tube lighting device as claimed in claim 1, wherein said low-impedance power source is mounted on a circuit board different from said circuit board.

3. The cold-cathode tube lighting device as claimed in claim 1, wherein said circuit board is a multi-layer circuit board.

4. The cold-cathode tube lighting device as claimed in claim 1, wherein said circuit board is a flexible printed circuit board.

5. The cold-cathode tube lighting device as claimed in claim 1, wherein said conductor layers are conductor films evaporated.

6. The cold-cathode tube lighting device as claimed in claim 1, wherein an impedance of each of said ballast capacitors, a combined impedance of a stray capacitance in the periphery of each of said cold-cathode tubes, and an impedance of each of said cold-cathode tubes during lighting are matched with each other.

7. The cold-cathode tube lighting device as claimed in claim 1, wherein a series connection circuit of at least two of said ballast capacitors is connected to the electrode at one end of each of said cold-cathode tubes.

8. The cold-cathode tube lighting device as claimed in claim 1, wherein a surface of said circuit board and a surface of each of said cold-cathode tubes are disposed so as to be separated from each other by a predetermined distance determined by a temperature difference and an electric potential difference between the surface of said circuit board and the surface of each of said cold-cathode tubes.

9. The cold-cathode tube lighting device as claimed in claim 1, wherein a surface of said circuit board is disposed so as to be perpendicular to a longitudinal direction of said cold-cathode tubes.

10. The cold-cathode tube lighting device as claimed in claim 9, wherein a conductor layer closest to said cold-cathode tubes among said conductor layers is connected to electrodes of said cold-cathode tubes, and a conductor layer farthest from said plurality of cold-cathode tubes among said conductor layers is connected to said low-impedance power source.

11. The cold-cathode tube lighting device as claimed in claim 9, wherein, when said circuit board includes at least three said conductor layers, a conductor layer closest to said cold-cathode tubes among said conductor layers and a conductor layer farthest from said plurality of cold-cathode tubes among said conductor layers are each connected to said low-impedance power source.

12. The cold-cathode tube lighting device as claimed in claim 1, wherein said low-impedance power source comprises a transformer connected to said ballast capacitors, and said transformer has an output impedance lower than the combined impedance of said plurality of cold-cathode tubes.

13. The cold-cathode tube lighting device as claimed in claim 12, wherein said transformer comprises a core, a primary winding being wound around said core, and a secondary winding being wound around at least one of the inside and outside of said primary winding.

14. The cold-cathode tube lighting device as claimed in claim 13, wherein said secondary winding has one configuration of a sectional winding and a honeycomb winding.

15. The cold-cathode tube lighting device as claimed in claim 1, wherein said low-impedance power source comprises power transistors connected to said ballast capacitors.

16. A liquid crystal display comprising:

a plurality of cold-cathode tubes;

a liquid crystal panel installed on the front side of said cold-cathode tubes, said liquid crystal panel shielding light emitted from said cold-cathode tubes using a predetermined pattern; and a cold-cathode tube lighting device, wherein said cold-cathode tube lighting device comprises:

a circuit board on which one end of each of said plurality of cold-cathode tubes is installed, said circuit board including at least two conductor layers;

a plurality of ballast capacitors each being a capacitance between said two conductor layers, at least one of said ballast capacitors being connected to an electrode at the one end of each of said cold-cathode tubes; and a low-impedance power source having an output impedance lower than a combined impedance of said plurality of ballast capacitors, said low-impedance power source supplying electric power to said cold-cathode tubes via said ballast capacitors.

* * * * *